US011061342B2

(12) United States Patent
Umeda et al.

(10) Patent No.: US 11,061,342 B2
(45) Date of Patent: Jul. 13, 2021

(54) ELECTROPHOTOGRAPHIC APPARATUS, PROCESS CARTRIDGE AND CARTRIDGE SET

(71) Applicant: CANON KABUSHIKI KAISHA, Tokyo (JP)

(72) Inventors: Noriyoshi Umeda, Shizuoka (JP); Tsuneyoshi Tominaga, Shizuoka (JP); Shohei Tsuda, Shizuoka (JP); Shohei Kototani, Shizuoka (JP); Masahiro Kurachi, Shizuoka (JP); Kazuhiro Yamauchi, Shizuoka (JP); Hideo Kihara, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/071,103

(22) Filed: Oct. 15, 2020

(65) Prior Publication Data

US 2021/0116828 A1 Apr. 22, 2021

(30) Foreign Application Priority Data

Oct. 18, 2019 (JP) ..... JP2019-191587

(51) Int. Cl.
*G03G 15/02* (2006.01)
*G03G 9/08* (2006.01)
(Continued)

(52) U.S. Cl.
CPC ..... *G03G 9/0821* (2013.01); *G03G 5/0553* (2013.01); *G03G 9/0823* (2013.01); *G03G 21/1814* (2013.01); *G03G 15/0233* (2013.01)

(58) Field of Classification Search
CPC ..... G03G 5/0553; G03G 9/08; G03G 9/0821; G03G 9/0823; G03G 15/0233; G03G 21/1814
See application file for complete search history.

(56) References Cited

U.S. PATENT DOCUMENTS 6,697,587 B2 2/2004 Harada
6,864,030 B2 3/2005 Shirai et al.
(Continued)

FOREIGN PATENT DOCUMENTS

JP 2002003651 A 1/2002
JP 2003107781 A 4/2003
(Continued)

OTHER PUBLICATIONS

U.S. Appl. No. 17/065,258, Kohei Makisumi, filed Oct. 7, 2020.
(Continued)

*Primary Examiner* — Hoang X Ngo
(74) *Attorney, Agent, or Firm* — Venable LLP

(57) ABSTRACT

An electrophotographic apparatus comprising an electrophotographic photosensitive member, a charging device, and a developing device, wherein the charging device comprises a conductive member arranged to be capable of contacting the electrophotographic photosensitive member, a conductive layer on the conductive member outer surface comprises a matrix and a plurality of domains dispersed in the matrix, at least some of the domains are exposed at the conductive member outer surface, the matrix has a volume resistivity of larger than $1.00\times10^{12}$ Ω·cm and is $1.0\times10^{5}$ times or more one of the domains, the developing device comprises the toner comprising a toner particle, fine particles A and B, the fine particle A has a volume resistivity of $1.0\times10^{3}$ to $1.0\times10^{10}$ Ω·cm, and the fine particle B is silica fine particle and having a volume resistivity of $1.0\times10^{11}$ to $1.0\times10^{17}$ Ω·cm.

10 Claims, 3 Drawing Sheets

(51) Int. Cl.
*G03G 21/18* (2006.01)
*G03G 5/05* (2006.01)

(56) References Cited

U.S. PATENT DOCUMENTS

| | | | |
|---|---|---|---|
| 7,799,398 | B2 | 9/2010 | Nakamura et al. |
| 8,298,670 | B2 | 10/2012 | Muranaka et al. |
| 8,449,975 | B2 | 5/2013 | Hirakoso et al. |
| 8,503,916 | B2 | 8/2013 | Anan et al. |
| 8,628,854 | B2 | 1/2014 | Yamauchi et al. |
| 8,660,472 | B2 | 2/2014 | Kurachi et al. |
| 8,668,987 | B2 | 3/2014 | Yamauchi et al. |
| 8,715,830 | B2 | 5/2014 | Yamada et al. |
| 8,771,818 | B2 | 7/2014 | Nishioka et al. |
| 8,852,743 | B2 | 10/2014 | Kikuchi et al. |
| 9,023,465 | B2 | 5/2015 | Yamada et al. |
| 9,086,643 | B2 | 7/2015 | Kikuchi et al. |
| 9,128,403 | B2 | 9/2015 | Yamauchi et al. |
| 9,146,482 | B2 | 9/2015 | Watanabe et al. |
| 9,360,789 | B1 | 6/2016 | Masu et al. |
| 9,442,408 | B2 | 9/2016 | Yamauchi et al. |
| 9,442,451 | B2 | 9/2016 | Yamauchi et al. |
| 9,541,854 | B2 | 1/2017 | Kikuchi et al. |
| 9,547,250 | B2 | 1/2017 | Kikuchi et al. |
| 9,551,947 | B2 | 1/2017 | Hiroko et al. |
| 9,551,949 | B2 | 1/2017 | Yamauchi et al. |
| 9,556,359 | B2 | 1/2017 | Suzumura et al. |
| 9,581,931 | B2 | 2/2017 | Yamada et al. |
| 9,599,913 | B2 | 3/2017 | Nishioka et al. |
| 9,639,009 | B2 | 5/2017 | Yamaguchi et al. |
| 9,651,888 | B2 | 5/2017 | Muranaka et al. |
| 9,665,028 | B2 | 5/2017 | Arimura et al. |
| 9,665,029 | B2 | 5/2017 | Hino et al. |
| 9,740,133 | B2 | 8/2017 | Yamauchi et al. |
| 9,811,009 | B2 | 11/2017 | Yamada et al. |
| 9,811,021 | B2 | 11/2017 | Muranaka et al. |
| 9,897,931 | B2 | 2/2018 | Nishioka et al. |
| 9,958,802 | B2 | 5/2018 | Kikuchi et al. |
| 9,964,874 | B2 | 5/2018 | Suzumura et al. |
| 9,964,881 | B2 | 5/2018 | Ikejiri et al. |
| 9,964,914 | B2 | 5/2018 | Arimura et al. |
| 9,977,353 | B2 | 5/2018 | Nishioka et al. |
| 10,018,927 | B2 | 7/2018 | Yamada et al. |
| 10,018,934 | B2 | 7/2018 | Yamada et al. |
| 10,108,129 | B2 | 10/2018 | Yamaguchi et al. |
| 10,280,148 | B2 | 5/2019 | Nishioka et al. |
| 10,416,588 | B2 | 9/2019 | Masu et al. |
| 10,488,777 | B2 | 11/2019 | Terauchi et al. |
| 10,649,350 | B2 | 5/2020 | Yamaguchi et al. |
| 10,678,154 | B2 | 6/2020 | Takashima et al. |
| 10,678,158 | B2 | 6/2020 | Kikuchi et al. |
| 2012/0251171 | A1 | 10/2012 | Muranaka et al. |
| 2012/0308261 | A1 | 12/2012 | Tsuru et al. |
| 2013/0236214 | A1* | 9/2013 | Koide ..... G03G 15/0818 399/176 |
| 2013/0281276 | A1 | 10/2013 | Watanabe et al. |
| 2014/0072343 | A1 | 3/2014 | Masu et al. |
| 2014/0080691 | A1 | 3/2014 | Kurachi et al. |
| 2014/0255838 | A1* | 9/2014 | Matsuda ..... G03G 5/14708 430/56 |
| 2015/0331346 | A1 | 11/2015 | Yamauchi et al. |
| 2020/0225593 | A1 | 7/2020 | Yamaguchi et al. |
| 2020/0310264 | A1 | 10/2020 | Kurachi et al. |
| 2020/0310265 | A1 | 10/2020 | Nishioka et al. |
| 2020/0310266 | A1 | 10/2020 | Kikuchi et al. |
| 2021/0033996 | A1 | 2/2021 | Kikuchi et al. |
| 2021/0041796 | A1 | 2/2021 | Nishioka et al. |

FOREIGN PATENT DOCUMENTS

| | | | |
|---|---|---|---|
| JP | 2003280246 | A | 10/2003 |
| JP | 2005049630 | A | 2/2005 |
| JP | 2012068623 | A | 4/2012 |
| JP | 2017107169 | A | 6/2017 |
| JP | 2017207680 | A | 11/2017 |
| JP | 2017211648 | A | 11/2017 |
| JP | 2018077385 | A | 5/2018 |
| JP | 2019045578 | A | 3/2019 |

OTHER PUBLICATIONS

U.S. Appl. No. 17/069,919, Tsutomu Nishida, filed Oct. 14, 2020.
U.S. Appl. No. 17/070,054, Yuka Ishiduka, filed Oct. 14, 2020.
U.S. Appl. No. 17/070,085, Fumiyuki Hiyama, filed Oct. 14, 2020.
U.S. Appl. No. 17/070,179, Kaname Watariguchi, filed Oct. 14, 2020.
U.S. Appl. No. 17/071,109, Shohei Kototani, filed Oct. 15, 2020.
U.S. Appl. No. 17/071,227, Kosuke Fukudome, filed Oct. 15, 2020.
U.S. Appl. No. 17/071,246, Tomohiro Unno, filed Oct. 15, 2020.
U.S. Appl. No. 17/071,283, Yoshitaka Suzumura, filed Oct. 15, 2020.
U.S. Appl. No. 17/071,535, Hiroyuki Tomono, filed Oct. 15, 2020.
U.S. Appl. No. 17/071,540, Tsuneyoshi Tominaga, filed Oct. 15, 2020.

* cited by examiner

ELECTROPHOTOGRAPHIC APPARATUS, PROCESS CARTRIDGE AND CARTRIDGE SET

BACKGROUND OF THE INVENTION

Field of the Invention

The present disclosure relates to an elecetrophotographic apparatus, a process cartridge and a cartridge set.

Description of the Related Art

In recent years, electrophotographic image forming apparatuses (hereinafter simply referred to as electrophotographic apparatuses) such as copiers and printers have been diversified in purpose and environment of use, and have been required to ensure stable image quality even in repeated use for a long period of time.

In an electrophotographic apparatus, a conductive member is used in a charging device. A configuration having a conductive support and a conductive layer provided on the support is known as a conductive member.

The conductive member plays a role of transporting an electric charge from the conductive support to the surface of the conductive member and giving a charge to a contacting body by discharging. This conductive member needs to ensure uniform charging of an electrophotographic photosensitive member to obtain high-quality electrophotographic images.

Japanese Patent Application Publication No. 2002-003651 discloses a rubber composition with a sea-island structure including a polymer continuous phase composed of an ion conductive rubber material having a raw material rubber A having volume resistivity of not more than $1\times10^{12}$ Ω·cm as a main component, and a polymer particle phase composed of an electronically conductive rubber material prepared by blending conductive particles into a raw material rubber B to make the rubber material conductive, and also discloses a charging member having an elastic layer formed from the rubber composition.

Meanwhile, the toner itself also has to exhibit stable charging performance in all environments through repeated use for a long time. An approach based on external additives is effective as a means for achieving this purpose. In Japanese Patent Application Publication No. 2005-049630, in order to maintain high flowability and charging performance of the toner over a long durability period, a method of adhering silica fine particles and hydrophobized titanium oxide fine particles to the toner is used.

SUMMARY OF THE INVENTION

The study conducted by the present inventors confirmed that the charging member according to Japanese Patent Application Publication No. 2002-003651 excels in uniform charging performance with respect to an electrophotographic photosensitive member.

However, it has been recognized that there is still room for improvement in speeding up the image forming process developed in recent years and long-term repeated durability.

Specifically, there is still room for improvement in terms of member contamination when the charging member according to Japanese Patent Application Publication No. 2002-003651 is used for forming an electrophotographic image, and when a toner to which silica fine particles and titanium oxide fine particles have been added is repeatedly used for a long time as in Japanese Patent Application Publication No. 2005-049630. That is, the silica fine particles and titanium oxide fine particles added to the toner may migrate from the toner and adhere to the charging member in a high-speed process and repeated use for a long time. The high-resistive silica fine particles that have thus adhered to the surface of the charging member cap the discharge sites of the charging member and hinder the discharge from the charging member.

Further, in the portion of the charging member to which the titanium oxide fine particles have adhered, the discharge from the charging member to the electrophotographic photosensitive member is performed through the titanium oxide fine particles, so that the uniform discharge from the charging member is also hindered.

In the case of a charging member to which silica fine particles or titanium oxide fine particles have thus adhered, minute potential unevenness formed on the surface of the electrophotographic photosensitive member before the charging step cannot be sufficiently equalized and charging uniformity cannot be maintained in a high-speed process. As a result, where such charging member is repeatedly used for a long time, charging ability is lowered and density unevenness (roughness) of a halftone image due to the potential unevenness is likely to occur.

Therefore, the present disclosure is aimed at providing an electrophotographic apparatus that contributes to the formation of high-quality electrophotographic images.

Another aspect of the present disclosure is aimed at providing a process cartridge and a cartridge set that contribute to the formation of a high quality electrophotographic image.

According to one aspect of the present disclosure, an elecetrophotographic apparatus comprising:

an electrophotographic photosensitive member;

a charging device for charging a surface of the electrophotographic photosensitive member; and a developing device for developing an electrostatic latent image formed on the surface of the electrophotographic photosensitive member with a toner to form a toner image on the surface of the electrophotographic photosensitive member, wherein the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix.

the matrix contains a first rubber, each of the domains contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^{5}$ times or more a volume resistivity Rd of the domains, the developing device comprises the toner, the toner comprises a toner particle containing a binder resin, and fine particle A and fine particle B both on a surface of the toner particle.

the fine particle A has a volume resistivity R1 of $1.0\times10^{3}$ to $1.0\times10^{10}$ Ω·cm, the fine particle B is silica fine particle, and the fine particle B has a volume resistivity R2 of $1.0\times10^{11}$ to $1.0\times10^{17}$ Ω·cm is provided.

According to other aspect of the present disclosure, a process cartridge detachably attachable to a main body of an electrophotographic apparatus, the process cartridge comprising:

a charging device for charging a surface of an electrophotographic photosensitive member; and a developing device for developing an electrostatic latent image formed on the surface of the electrophotographic photosensitive member with a toner to form a toner image on the surface of the electrophotographic photosensitive member, wherein the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix, the matrix contains a first rubber;

each of the domains contains a second rubber and an electronic conductive agent.

at least some of the domains are exposed at the outer surface of the conductive member.

the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^{5}$ times or more a volume resistivity Rd of the domains, the developing device comprises the toner, the toner comprises a toner particle containing a binder resin, and fine particle A and fine particle B both on a surface of the toner particle, the fine particle A has a volume resistivity R1 of $1.0\times10^{3}$ to $1.0\times10^{10}$ Ω·cm, the fine particle B is silica fine particle, and the fine particle B has a volume resistivity R2 of $1.0\times10^{11}$ to $1.0\times10^{17}$ Ω·cm is provided.

According to other aspect of the present disclosure, a cartridge set that is detachably attachable to a main body of an electrophotographic apparatus and comprises a first cartridge and a second cartridge, wherein the first cartridge comprises a charging device for charging a surface of an electrophotographic photosensitive member; and a first frame for supporting the charging device, and the second cartridge comprises a toner container that accommodates a toner for developing an electrostatic latent image formed on the surface of the electrophotographic photosensitive member to form a toner image on the surface of the electrophotographic photosensitive member, the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix.

the matrix contains a first rubber, each of the domain contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^{5}$ times or more a volume resistivity Rd of the domains, the toner comprises a toner particle containing a binder resin, and fine particle A and fine particle B both on a surface of the toner particle, the fine particle A has a volume resistivity R1 of $1.0\times10^{3}$ to $1.0\times10^{10}$ Ω·cm.

the fine particle B is silica fine particle, and the fine particle B has a volume resistivity R2 of $1.0\times10^{11}$ to $1.0\times10^{17}$ Ω·cm is provided.

According to the present disclosure, an electrophotographic apparatus, a process cartridge and a cartridge set that contribute to the formation of high-quality electrophotographic images can be provided.

Further features of the present invention will become apparent from the following description of exemplary embodiments with reference to the attached drawings.

DESCRIPTION OF THE EMBODIMENTS

Figure 1:
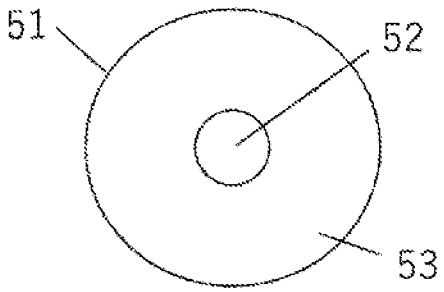
FIG. 1 is a cross-sectional view of a conductive roller in a direction orthogonal to the longitudinal direction.

In the present disclosure, the description "from XX to YY" or "XX to YY" representing a numerical range means a numerical range including a lower limit and an upper limit which are endpoints, unless otherwise specified.

Also, if the numerical ranges are listed in stages, the upper and lower limits of each numerical range can be combined as appropriate.

One aspect of the present disclosure is an electrophotographic apparatus comprising:

an electrophotographic photosensitive member;

a charging device for charging a surface of the electrophotographic photosensitive member; and a developing device for developing an electrostatic latent image formed on the surface of the electrophotographic photosensitive member with a toner to form a toner image on the surface of the electrophotographic photosensitive member, wherein the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix.

the matrix contains a first rubber, each of the domains contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm.

the volume resistivity Rm of the matrix is $1.0\times10^{5}$ times or more a volume resistivity Rd of the domains, the developing device comprises the toner, the toner comprises a toner particle containing a binder resin, and fine particle A and fine particle B both on a surface of the toner particle, the fine particle A has a volume resistivity R1 of $1.0\times10^{3}$ to $1.0\times10^{10}$ Ω·cm, the fine particle B is silica fine particle, and the fine particle B has a volume resistivity R2 of $1.0\times10^{11}$ to $1.0\times10^{17}$ Ω·cm.

According to the study conducted by the present inventors, by using the electrophotographic apparatus as described above, it is possible to maintain the charging ability and obtain a uniform halftone image free of roughness even in a high-speed process and repeated use for a long time. The present inventors presume that this is due to the following reasons.

It is conceivable that where an electrophotographic apparatus is repeatedly used in a high-speed process for a long time, the medium-resistance fine particle A that migrated from the toner as a result of adopting the above configuration are likely to adhere to the domains exposed at the outer surface of the conductive member.

Meanwhile, it is believed that the high-resistance fine particle B that migrated from the toner are likely to adhere to the matrix having a high volume resistivity. This is considered to be due to the material of the fine particle. Since the fine particle B is silica fine particle, they tend to be negatively charged due to the physical properties of the material. By contrast, the fine particle A having a medium resistance tend to bear a positive charge relative to the silica fine particle.

The volume resistivity of the domains exposed at the outer surface of the conductive member tends to be low because an electronic conductive agent is contained. When the electrophotographic photosensitive member is to be negatively charged, the outer surface of the conductive member holds a lot of negative charges.

The outer surface of the conductive member is composed of the matrix and the domains exposed at the outer surface of the conductive member, and the volume resistivity of the matrix is $1.0\times10^{5}$ times or more the volume resistivity of the domains. Therefore, it is considered that negative charges are concentrated in the domains.

As a result, the fine particle A having a positive charge are likely to selectively adhere to the domains where the negative charges are concentrated. Meanwhile, since an electrostatic repulsion force is generated from the domains, the fine particle B easily adhere to the matrix.

It is considered that since the matrix has the volume resistivity of larger than $1.00\times10^{12}$ Ω·cm, even if the fine particle B having no conductivity adhere, the charging characteristics are not significantly affected.

Meanwhile, it is necessary to transfer negative charges to the domains and negatively charge the electrophotographic photoreceptor. Therefore, the fine particle A that have adhered to the domains have a volume resistivity R1 of $1.0\times10^{3}$ to $1.0\times10^{10}$ Ω-cm so as not to suppress the movement of charges.

By using two types of fine particle in this way, it is possible to maintain a uniform discharge of the conductive material even during a high-speed process and repeated use for a long time.

Further, since the toner uses the fine particle A having medium resistance and the silica fine particle as the fine particle B having high resistance in combination, stable charging performance is maintained in all environments even in a high-speed process and repeated use for a long time.

Due to the above, even when used repeatedly for a long time in a high-speed process, the conductive member maintains a uniform charging characteristic with respect to the electrophotographic photosensitive member, and the toner can also maintain high flowability and charging performance. It is considered that as a result, it is easy to obtain a uniform halftone image without roughness.

First, the conductive member as the charging member of the charging device will be described, but this description is not limiting.

The inventors investigated the reason why it is difficult to uniformly charge the surface of the electrophotographic photosensitive member when the fine particle A and the fine particle B migrate to the charging member according to Japanese Patent Application Publication No. 2002-003651.

In the investigation, the attention was focused on the role of the polymer particle phase made of an electronically conductive rubber material in the charging member according to Japanese Patent Application Publication No. 2002-003651. That is, it is considered that in the elastic layer (conductive layer), electron conductivity is imparted to the conductive layer by the transfer of electrons between polymer particle phases.

Also, the ion conductive rubber material forming the polymer continuous phase has the volume resistivity of $1.0\times10^{12}$ Ω·cm or less. It is considered that the fine particle A and the fine particle B that migrated to the charging member having such a matrix-domain structure randomly adhere to the polymer particle phase and the polymer continuous phase. As a result, the flow of electrons becomes uneven in the conductive layer, and the discharge from the outer surface of the charging member to the electrophotographic photosensitive member becomes uneven. It is considered that this makes the surface potential of the electrophotographic photosensitive member non-uniform.

Accordingly, as a result of repeated studies, the present inventors have found that a conductive member and toner satisfying the following requirements (A), (B) and (C) are effective in solving the problem.

Requirement (A):

The conductive member comprises a support having a conductive outer surface, and a conductive layer provided on the outer surface of the support; and the conductive layer comprises a matrix and a plurality of domains dispersed in the matrix.

The matrix contains a first rubber, and each of the domains contains a second rubber and an electronic conductive agent.

At least some of the domains are exposed at the outer surface of the conductive member; and the outer surface of the conductive member is composed of at least the matrix and the domains exposed at the outer surface of the conductive member.

The outer surface of the conductive member is the surface of the conductive member that contacts the toner.

Requirement (B)

The matrix has the volume resistivity Rm of larger than $1.00\times10^{12}$ Ω·cm, and the volume resistivity Rm of the matrix is $1.0\times10^{5}$ times or more the volume resistivity Rd of the domains.

Requirement (C)

The toner comprises a toner particle containing a binder resin, and fine particle A and fine particle B both on the toner particle surface.

The fine particle A has volume resistivity R1 of $1.0\times10^{3}$ to $1.0\times10^{10}$ Ω·cm, the fine particle B is silica fine particle, and the fine particle B has the volume resistivity R2 of $1.0\times10^{11}$ to $1.0\cdot10^{17}$ Ω·cm.

The conductive member will be described with reference to FIG. 1 using a roller-shaped conductive member (hereinafter also referred to as a conductive roller) as an example. FIG. 1 is a cross-sectional view in a direction orthogonal to the longitudinal direction, which is the axial direction of the conductive roller. A conductive roller 51 has a columnar shape and includes a support 52 having a conductive outer surface, and a conductive layer 53 provided on the outer periphery of the support 52, that is, on the outer surface of the support.

The material constituting the support having the conductive outer surface may be selected, as appropriate, from materials known in the field of conductive members for electrophotography and materials that can be used as conductive members. Examples thereof include synthetic resin having conductivity and metals and alloys such as aluminum, stainless steel, iron, copper alloy, and the like.

Furthermore, these may be subjected to oxidation or plating with chromium, nickel, or the like. Either electroplating or electroless plating can be used as the type of plating. From the viewpoint of dimensional stability, electroless plating is preferable. Examples of the electroless plating used here include nickel plating, copper plating, gold plating, and various types of alloy plating.

The thickness of the plated layer is preferably 0.05 pm or more, and considering the balance between work efficiency and rust prevention ability, the thickness of the plated layer is preferably from 0.10 pm to 30.00 pm. The cylindrical shape of the support may be a solid cylindrical shape or a hollow cylindrical shape (round tubular shape). The outer diameter of this support is preferably in the range of from 3 mm to 10 mm.

Where a medium-resistance layer or an insulating layer is present between the support and the conductive layer, it may not be possible to quickly supply the charge after the charge has been consumed by the discharge. Therefore, the conductive layer may be provided directly on the support, or the conductive layer may be provided on the outer periphery of the support only with an intermediate layer composed of a thin film and a conductive resin layer such as a primer interposed therebetween.

As the primer, known materials can be selected and used according to the rubber material for forming the conductive layer and the material of the support. The material of the primer can be exemplified by a thermosetting resin and a thermoplastic resin. Specifically, known materials such as phenolic resins, urethane resins, acrylic resins, polyester resins, polyether resins, and epoxy resins can be used.

Figure 2:
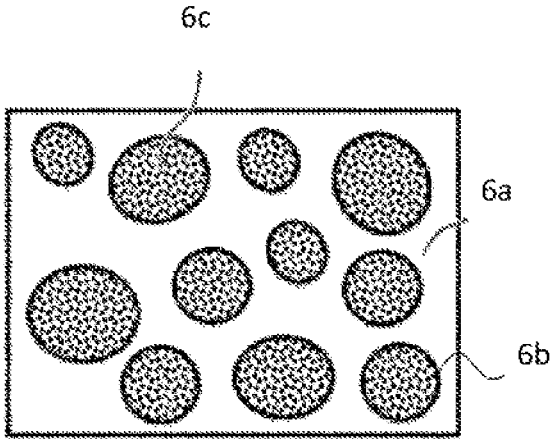
FIG. 2 is a partial cross-sectional view of a conductive layer.

FIG. 2 shows an example of a partial cross-sectional view of the conductive layer in a direction orthogonal to the longitudinal direction of the conductive roller.

The conductive layer has a matrix-domain structure having a matrix 6*a* containing a first rubber and domains 6*b* containing a second rubber and an electronic conductive agent. As shown in the figure, the domain 6*b* includes an electronic conductive agent 6*c*.

It is considered that in a conductive layer, when a bias is applied between a support of a conductive member having a conductive layer satisfying the above requirements (A) and (B) and an electrophotographic photosensitive member, the electric charges move in the following manner from the support side of the conductive layer to the outer surface side of the conductive member which is the opposite side.

First, the electric charges are accumulated near the interfaces between the matrix and the domains. Then, the charges are sequentially transferred from the domains located on the support side to the domains located on the side opposite to the support side, and reach the surface on the side of the conductive layer opposite to the support side (hereinafter also referred to as the outer surface of the conductive layer). At this time, where the charges of all the domains move to the outer surface side of the conductive layer in one charging step, it takes time to accumulate the electric charges in the conductive layer for the next charging step. Thus, it becomes difficult to adapt to a high-speed electrophotographic image forming process. Therefore, it is preferable that transfer of charges between the domains does not occur simultaneously even when a charging bias is applied. In addition, in a high-speed electrophotographic image forming process, since the movement of charges is restricted, it is preferable that a sufficient amount of electric charges be accumulated in each domain in order to discharge a sufficient amount of charges in one discharge. With the conductive member provided with a conductive layer satisfying the above requirements (A) and (B), simultaneous transfer of charges between the domains when a charging bias is applied is restricted, and sufficient amount of charges can be accumulated in the domains.

As described above, by making the volume resistivity Rm of the matrix larger than $1.00\times10^{12}$ Ω·cm, it is possible to prevent the electric charges from bypassing the domains and moving in the matrix. Thus, it is possible to suppress the consumption of most of the accumulated charges by one discharge. In addition, it is possible to prevent the occurrence of a state where conductive paths are formed, as if communicating inside the conductive layer, by the leakage of electric charges accumulated in the domains to the matrix. As a result, it is possible to suppress the deterioration of the charging ability, and it is possible to suppress the occurrence of roughness of the halftone image.

The volume resistivity Rm is preferably $1.00\times10^{14}$ Ω·cm or more, and more preferably $1.00\times10^{16}$ Ω·cm or more. Meanwhile, the upper limit of the volume resistivity Rm is not particularly limited, but as a guide, it is preferably $1.00\times10^{17}$ Ω·cm or less.

The present inventors believe that an effective means for moving the electric charges through the domains in the conductive layer and achieving a fine discharge in a high-speed electrophotographic image forming process is to separate regions (domains) in which the electric charges have been sufficiently accumulated by an electrically insulating region (matrix). By setting the volume resistivity of the matrix within the range of a high-resistance region as described above, it is possible to retain sufficient amount of electric charges at the interface between the matrix and the domains, and it is possible to suppress charge leakage from the domains.

It was also found that it is effective to limit a charge transfer path to a path through the domains interposed in order to achieve a minute discharge and a necessary and sufficient discharge amount. By suppressing the leakage of electric charges from the domains to the matrix and limiting the charge transfer path to a path through the plurality of domains, it is possible to increase the density of the charges present in the domains. As a result, the charging amount of electric charges in each domain can be further increased.

With this, it is possible to increase the total number of electric charges that can participate in the discharge on the surface of the domains as a conductive phase that is the starting point of the discharge. It is considered that as a result, the discharge from the surface of the conductive member can be facilitated.

Further, the discharge generated from the outer surface of the conductive layer is inclusive of an effect in which electric charges are extracted by an electric field from the domains as the conductive phase, and also and simultaneously a γ effect in which positive ions generated by the ionization of air by the electric field collide with the surface of the conductive layer where negative electric charges are present, and release the electric charges from the surface of the conductive layer. As described above, electric charges can be caused to be present at a high density in the domains as a conductive phase on the surface of the conductive member. It is therefore supposed that the efficiency of generation of discharge charges when positive ions are caused by the electric field to collide with the surface of the conductive layer can be increased, and a state can be assumed in which more discharge charges can be generated easier than with the conventional conductive members.

Moreover, it is assumed that by making the volume resistivity Rm of the matrix larger than $1.00\times10^{12}$ Ω·cm, the fine particle B migrated from the toner are likely to adhere to the segment constituted by the matrix having a high volume resistivity.

The volume resistivity Rm (unit: Ω·cm) of the matrix can be measured with a microprobe after thinning the conductive layer. A means capable of producing a very thin sample, such as a sharp razor, a microtome, or a focused ion beam method (FIB), may be used for thinning. The specific procedure will be described hereinbelow.

The volume resistivity Rm of the matrix is $1.0\times10^{3}$ times or more the volume resistivity Rd of the domains. The matrix contains almost no electronic conductive agent such as carbon black, and has a higher electric resistance than the domains. Setting the relationship between Rm and Rd within the above range is effective from the viewpoint of forming the conductive path of the domains. Further, since the fine particle A that have migrated from the toner have a volume resistivity close to that of the domains and are more positively charged than the fine particle B, the fine particle A easily adhere to the domains. Even if the fine particle A are accumulated in the domain segments as a result of repeated use for a long time, since the volume resistivity is close to that of the domains, the charging ability can be maintained without hindering the movement of charges.

That is, when the volume resistivity Rm of the matrix is less than $1.0\times10^{3}$ times the volume resistivity Rd of the domains, the conductive path becomes uncertain, and uniform discharge is likely to be hindered. As a result, roughening of the halftone image is likely to occur.

The Rm is preferably $1.0\times10^{5}$ to $1.0\times10^{20}$ times, more preferably from $1.0\times10^{6}$ to $1.0\times10^{18}$ times, and even more preferable from $9.0\times10^{6}$ times to $1.0\times10^{16}$ times Rd.

The v domains may have the volume resistivity Rd of $1.00\times10^{1}$ to $1.00\times10^{17}$ Ω·cm.

Further, Rd is preferably from $1.00\times10^{1}$ Ω·cm to $1.00\times10^{6}$ Ω·cm, more preferably from $1.00\times10^{1}$ Ω·cm to $1.00\times10^{4}$ Ω·cm, and even more preferably from $1.00\times10^{1}$ Ω·cm to $1.00\times10^{2}$ Ω·cm.

By setting the volume resistivity Rd of the domains to a lower state, it is possible to more effectively limit the charge transport path to a path through a plurality of domains while suppressing unintended charge transfer in the matrix.

Further, by reducing the volume resistivity Rd of the domains to the above range, the amount of electric charges moving in the domains can be dramatically increased.

The volume resistivity Rd of the domains may be adjusted, for example, by changing the type and addition amount of the electronic conductive agent with respect to the rubber component of the domains.

The matrix contains a first rubber, and the each of domains contains a second rubber and an electronic conductive agent.

A rubber composition containing a rubber material for the matrix (first rubber) may be used as a rubber material for the domains (second rubber). Details will be described hereinbelow.

In order to form the matrix-domain structure, it is preferable that the difference in a solubility parameter (SP value) with the rubber material forming the matrix be within a certain range. That is, the absolute value of the difference between the SP value of the first rubber and the SP value of the second rubber is preferably from 0.4 $(J/cm^3)^{0.5}$ to 5.0 $(J/cm^3)^{0.5}$. Further, this value is more preferably from 0.4 $(J/cm^3)$ to 2.2 $(J/cm^3)^{0.5}$.

The volume resistivity Rd of the domains can be adjusted by selecting, as appropriate, the type and addition amount of the electronic conductive agent. An electronic conductive agent that makes it possible to change significantly the volume resistivity from high resistance to low resistance by the dispersed amount of the agent is preferable as the electronic conductive agent to be used for controlling the volume resistivity Rd of the domains to be from $1.00\times10^{1}$ Ω·cm to $1.00\times10^{7}$ Ω·cm.

Examples of the electronic conductive agent to be blended in the domains include carbon black, graphite, oxides such as titanium oxide, and tin oxide, metals such as Cu and Ag, particles coated with an oxide or a metal to make them electrically conductive, and the like. Further, if necessary, two or more kinds of these conductive agents may be blended and used in an appropriate amount.

Among the above electronic conductive agents, it is preferable to use conductive carbon black, which has a large affinity with rubber and makes it possible to control easily the distance between the electronic conductive agents. The type of carbon black to be blended in the domains is not particularly limited. Specific examples thereof include gas furnace black, oil furnace black, thermal black, lamp black, acetylene black, Ketjen black, and the like.

Among them, conductive carbon black having a DBP oil absorption amount from 40 $cm^3$/100 g to 170 $cm^3$/100 g, which can impart high conductivity to the domains, can be preferably used.

The amount of the electronic conductive agent such as conductive carbon black is preferably from 20 parts by mass to 150 parts by mass, and more preferably from 50 parts by mass to 100 parts by mass with respect to 100 parts by mass of the second rubber contained in the domains.

It is preferable that the electronic conductive agent be blended in an amount larger than that in the conductive member for general electrophotography. As a result, the volume resistivity Rd of the domains can be easily controlled within the range from $1.00\times10^{1}$ Ω·cm to $1.00\times10^{7}$ Ω·cm.

Further, if necessary, a filler, a processing aid, a crosslinking aid, a crosslinking accelerator, an antiaging agent, a crosslinking accelerator, a crosslinking retarder, a softener, a dispersant, a colorant, and the like which are generally used as compounding agents for rubber may be added to the rubber composition for domains within a range that does not impair the effects according to the present disclosure.

The volume resistivity Rd of the domains may be measured by the same method as that suitable for measuring the volume resistivity Rm of the matrix, except that the measurement site is changed to a place corresponding to the domain and the applied voltage at the time of measuring the current value is changed to 1 V. The specific procedure will be described hereinbelow.

Here, it is preferable that the volume resistivity of the domains be uniform. In order to improve the uniformity of the volume resistivity of the domains, it is preferable to make the amount of the electronic conductive agent in each domain uniform. This can further stabilize the discharge from the outer surface of the conductive member to the body to be charged.

From the viewpoint of charge transfer between the domains, it is preferable that the arithmetic mean value Lw of the distances between the adjacent wall surfaces of the domains in the conductive layer (hereinafter, also simply referred to as the "interdomain distance Lw") in the cross-section observation of the conductive member be, for example, from 0.10 μm to 7.00 μm, more preferably from 0.20 μm to 6.00 μm, and further preferably from 0.20 μm to 4.00 μm.

In order to accumulate more sufficient amount of electric charges in the domains by reliably separating the domains by the insulating regions (matrix), the interdomain distance Lw may be set, for example, from 0.20 μm to 2.00 μm. By setting the interdomain distance Lw in the above range, the charging uniformity of the electrophotographic photosensitive member is improved, and roughness of a halftone image can be suppressed.

The interdomain distance Lw may be measured in the following manner.

First, a sample is cut out by the same method as the method for measuring the volume resistivity of the matrix described above. Further, in order to suitably observe the matrix-domain structure, a pretreatment such as dyeing or vapor deposition that can ensure a favorable contrast between the conductive phase and the insulating phase may be performed.

The presence of the matrix-domain structure is confirmed by observing with a scanning electron microscope (SEM) the slice on which a fracture surface has been formed and the pretreatment has been performed.

In this process, from the viewpoint of accuracy of quantitative representation of the domain area, it is preferable to perform the SEM observation at a magnification of from 1,000 to 100,000 times. The specific procedure will be described hereinbelow.

A smaller arithmetic mean value D of the circle-equivalent diameter of the domains in the conductive layer in the cross-section observation of the conductive member (hereinafter, simply referred to as domain diameter D) is preferable.

The domain diameter D is, for example, preferably from 0.10 μm to 6.00 μm, and more preferably from 0.10 μm to 5.00 μm. For example, the domain diameter D is preferably 0.10 μm or more, 0.15 μm or more, and 0.20 μm or more. Further, for example, the domain diameter D is preferably 6.00 μm or less, 5.00 μm or less, 2.00 μm or less, 1.00 μm or less, 0.50 μm or less, and 0.40 μm or less. These numerical ranges can be combined as appropriate. When the domain diameter D is in the above range, a high effect can be expected.

The domain diameter Ds (μm) is defined as the arithmetic mean value Ds of the circle-equivalent diameters of the domains in the conductive layer when the outer surface of the conductive member is observed. At that time, the Ds is preferably from 0.10 μm to 2.00 μm, more preferably from 0.15 μm to 1.00 μm, and further preferably from 0.20 μm to 0.70 μm. Within the above ranges, even if the fine particle A adhere to the domains on the outer surface, the charging ability is not hindered, and therefore, the generation of roughness in the halftone image can be further suppressed.

The conductive member may be formed, for example, by a method including the following steps (i) to (iv).

Step (i): a step of preparing a domain-forming rubber mixture (hereinafter, also referred to as "CMB") including an electronic conductive agent such as carbon black and the second rubber.

Step (ii): a step of preparing a matrix-forming rubber mixture (hereinafter also referred to as "MRC") including the first rubber.

Step (iii): a step of kneading CMB and MRC to prepare a rubber mixture having a matrix-domain structure.

Step (iv): a step of forming a layer of the rubber mixture prepared in step (iii) on a conductive support directly or with another layer interposed therebetween, and curing the layer of the rubber composition is cured to form a conductive layer.

The requirement (A) and requirement (B) can be controlled, for example, by selecting the materials to be used in each of the above steps and adjusting the production conditions. This will be described hereinbelow.

Regarding the requirement (B), the volume resistivity of the matrix is determined by the composition of MRC.

A rubber having low conductivity is preferable as the first rubber used for MRC.

Such rubber may be at least one rubber selected from the group consisting of natural rubber, butadiene rubber, butyl rubber, acrylonitrile butadiene rubber, urethane rubber, silicone rubber, fluororubber, isoprene rubber, chloroprene rubber, styrene butadiene rubber, ethylene propylene rubber, ethylene propylene diene rubber, and polynorbornene rubber.

The first rubber is preferably at least one selected from the group consisting of butyl rubber, styrene butadiene rubber, and ethylene propylene diene rubber.

Further, provided that the volume resistivity of the matrix is within the above range, a filler, a processing aid, a crosslinking agent, a crosslinking aid, a crosslinking accelerator, a crosslinking enhancing agent, a crosslinking retarder, an antiaging agent, a softening agent, a dispersant, a coloring agent and the like may be added, as necessary to the MRC. Meanwhile, it is preferable that the MRC does not contain an electronic conductive agent such as carbon black in order to keep the volume resistivity of the matrix within the above range.

Further, regarding the requirement (B), the adjustment can be made by the amount of the electronic conductive agent in the CMB. For example, where the conductive carbon black having a DBP oil absorption from 40 $cm^3$/100 g to 170 $cm^3$/100 g (preferably from 40 $cm^3$/100 g to 80 $cm^3$/100 g) is used as the electronic conductive agent, the requirement (B) can be achieved by preparing the CMB so as to include the conductive carbon black in an amount of from 40 parts by mass to 200 parts by mass of with respect to 100 parts by mass of the second rubber.

Furthermore, regarding the distributed state related to the domains such as the interdomain distances Lw and Lws, which is described below, and the domain diameters D and Ds, it is effective to control the following four parameters (a) to (d).

(a) Difference in interfacial tension a between CMB and MRC.

(b) Ratio (ηm/ηd) of MRC viscosity (m) and CMB viscosity (ηd).

(c) Shear rate (γ) during kneading of CMB and MRC and energy amount (EDK) during shearing in step (iii).

(d) Volume fraction of CMB with respect to MRC in step (iii).

(a) Difference in Interfacial Tension Between CMB and MRC

Generally, when two types of incompatible rubbers are mixed, phase separation occurs. This is because the interaction between the same polymers is stronger than the interaction between the different polymers, so that the same polymers agglomerate to reduce the free energy and cause stabilization.

Since the interface of the phase-separated structure comes into contact with different polymers, the free energy becomes higher than that on the inside which is stabilized by the interaction of the same molecules. As a result, in order to reduce the free energy of the interface, interfacial tension aimed at the reduction in area of contact with the different polymer is generated. When the interfacial tension is small, even different polymers tend to be mixed more uniformly in order to increase entropy. The state of being uniformly mixed is dissolution, and the SP value (solubility parameter), which is a measure of solubility, and the interfacial tension tend to be correlated.

That is, it is considered that the difference in interfacial tension between CMB and MRC correlates with the difference in SP value between the rubbers contained therein. The difference between the absolute values of solubility parameter (SP value) of the first rubber in MRC and solubility parameter (SP value) of the second rubber in CMB is preferably from 0.4 $(J/cm^3)^{0.5}$ to 5.0 $(J/cm)^5$. More preferably, rubbers may be selected such that the difference is from 0.4 $(J/cm^3)^{0.5}$ to 2.2 $(J/cm^3)^{0.5}$. Within this range, a stable phase separation structure can be formed, and the domain diameter D of CMB can be reduced.

Here, the second rubber that can be used for CMB can be specifically exemplified by at least one rubber selected from the group consisting of natural rubber (NR), isoprene rubber (IR), butadiene rubber (BR), acrylonitrile butadiene rubber (NBR), styrene butadiene rubber (SBR), butyl rubber (IIR), ethylene propylene rubber (EPM), ethylene propylene diene rubber (EPDM), chloroprene rubber (CR), nitrile rubber (NBR), hydrogenated nitrile rubber (H-NBR), silicone rubber, and urethane rubber (U).

The second rubber is preferably at least one selected from the group consisting of styrene butadiene rubber (SBR), butyl rubber (11R), and acrylonitrile butadiene rubber (NBR), and more preferably at least one selected from the group consisting of styrene butadiene rubber (SBR) and butyl rubber (IIR).

The thickness of the conductive layer is not particularly limited as long as the intended function and effect of the conductive member can be obtained. The thickness of the conductive layer is preferably from 1.0 mm to 4.5 mm.

The mass ratio of domains to matrix (domain:matrix) is preferably from 5:95 to 40:60, more preferably from 10:90 to 30:70, and further preferably from 15:85 to 25:75.

Method for Measuring SP Value

The SP value can be calculated accurately by creating a calibration curve using a material with a known SP value. As the known SP value, the catalog value of the material manufacturer can be used. For example, the SP value of NBR and SBR does not depend on the molecular weight, and is substantially determined by the content ratio of acrylonitrile and styrene.

Therefore, by analyzing the content ratio of acrylnitrile or styrene in the rubbers constituting the matrix and domains by using an analysis method such as pyrolysis gas chromatography (Py-GC) and solid-state NMR, it is possible to calculate the SP value calibration curve obtained from a material having a known SP value.

The SP value of isoprene rubber is determined by an isomer structure of 1,2-polyisoprene, 1,3-polyisoprene, 3,4-polyisoprene, cis-1,4-polyisoprene, trans-1,4-polyisoprene, and the like. Therefore, similarly to SBR and NBR, it is possible to analyze the isomer content ratio by Py-GC, solid-state NMR, and the like, and the SP value can be calculated from a material having a known SP value.

The SP value of a material with a known SP value is obtained by a Hansen sphere method.

(b) Viscosity Ratio of CMB and MRC

The ratio of CMB viscosity to MRC viscosity (CMB viscosity/MRC viscosity) (ηd/ηm) is preferably from 1.0 to 2.0. The domain diameter and the distance between adjacent wall surfaces of the domains can be adjusted more easily within the above range.

The (CMB viscosity/MRC viscosity) ratio can be adjusted by selecting the Mooney viscosity of the raw material rubbers used for CMB and MRC, and by changing the type and amount of the filler to be blended.

It is also possible to add a plasticizer such as paraffin oil to the extent that the formation of a phase-separated structure is not impaired. Further, the viscosity ratio can be adjusted by adjusting the temperature during kneading. The viscosity of the rubber mixture for forming the domains and the rubber mixture for forming the matrix can be obtained by measuring the Mooney viscosity ML (1+4) at the rubber temperature during kneading on the basis of JIS K 6300-1: 2013.

(c) Shear Rate During Kneading of MRC and CMB. And Energy Amount During Shear

The interdomain distances can be made smaller as the shear rate during kneading of MRC and CMB is higher and the energy amount at the time of shear is larger.

The shear rate can be increased by increasing the inner diameter of a stirring member such as a blade or screw of a kneading machine, decreasing a gap between the end surface of the stirring member and the inner wall of the kneading machine, or increasing the rotation speed. Further, the energy at the time of shearing can be increased by increasing the rotation speed of the stirring member or by increasing the viscosities of the second rubber in the CMB and the first rubber in the MRC.

(d) Volume Fraction of CMB with Respect to MRC

The volume fraction of CMB with respect to MRC correlates with the collision coalescence probability of the domain-forming rubber mixture with respect to the matrix-forming rubber mixture. Specifically, when the volume fraction of the domain-forming rubber mixture with respect to the matrix-forming rubber mixture is reduced, the collision and coalescence probability of the domain-forming rubber mixture and the matrix-forming rubber mixture decreases. That is, the interdomain distances can be reduced by reducing the volume fraction of the domains in the matrix within a range where the required conductivity can be obtained. The volume fraction of the CMB with respect to the MRC (that is, the volume fraction of the domains with respect to the matrix) is preferably from 15% to 40%.

Carbon black having a DBP oil absorption amount of from 40 $cm^3$/100 g to 80 $cm^3$/100 g can be particularly preferably used as the electronic conductive agent in order to obtain domains densely filled with the electronic conductive agent. The DBP oil absorption amount ($cm^3$/100 g) is the volume of dibutyl phthalate (DBP) that can be absorbed by 100 g of carbon black, and this amount can be measured according to Japanese Industrial Standard (UIS) K 6217-4: 2017 (Carbon Black for Rubber: Basic Characteristics—Part 4: Measurement of Oil Absorption Amount (Including Compressed Sample)). Generally, carbon black has a tuned higher-order structure in which primary particles having an average particle diameter of from 10 nm to 50 nm are aggregated. This tufted higher-order structure is called a structure, and the degree thereof is quantified by the DBP oil absorption ($cm^3$/100 g).

Generally speaking, carbon black with a well-developed structure has a high ability to reinforce rubber, such carbon black is poorly incorporated into rubber, and the shear torque during kneading is extremely high. Therefore, it is difficult to increase the filling amount in the domains.

Meanwhile, the conductive carbon black having a DBP oil absorption within the above range has a less-developed structure configuration, so that the carbon black is less aggregated and has good dispersibility in rubber. Therefore, the filling amount in the domains can be increased, and as a result, the outer shape of the domain can be more easily brought closer to a sphere.

Furthermore, in carbon black with a well-developed structure, carbon black particles tend to aggregate together, and the aggregates tend to form lumps with large uneven structures. Where such an aggregate is included in the domain, it is difficult to obtain the domain satisfying the requirement (B). The formation of aggregates may affect the shape of the domains and lead to the formation of an uneven structure. Meanwhile, conductive carbon black having a DBP oil absorption within the above range is preferable because the aggregates are unlikely to be formed.

In order to further reduce the concentration of electric field between the domains, the outer shape of the domains may be brought closer to a sphere. For that purpose, the domain diameter D may be made smaller within the above range. As a method therefor, for example, in the step (iii), MRC and CMB are kneaded so that MRC and CMB are phase-separated. Then, a method for controlling the CMB domain diameter D to a smaller value in the step of preparing a rubber mixture in which CMB domains are formed in the MRC matrix can be used. By reducing the CMB domain diameter D, the specific surface area of the CMB domains increases and the interface with the matrix increases, so that tension that tends to reduce the tension acts on the interface of the CMB domains. As a result, the external shape of the CMB domains is closer to that of a sphere.

Here, regarding the factors that determine the domain diameter in the matrix-domain structure formed when two incompatible polymers are melt-kneaded, a Taylor's equation (formula (6)), a Wu's empirical equation (formulas (7), (8)), and a Tokita's equation (formula (9)) are known.

Taylor's Equation $$D=[C\cdot\sigma/\eta m\cdot\gamma]:f(\eta m/\eta d) \quad (6)$$

Wu's Empirical Equation $$\gamma\cdot D\cdot\eta m/\sigma=4(\eta d/\eta m)0.84\cdot\eta d/\eta m>1 \quad (7)$$

$$\gamma\cdot D\cdot\eta m/\sigma=4(\eta d/\eta m)-0.84\cdot\eta d/\eta m<1 \quad (8)$$

Tokita's Equation $$D=12\cdot P\cdot\sigma\cdot\varphi/(\pi\cdot\eta\cdot\gamma)\cdot(1+4\cdot P\cdot\varphi\cdot EDK/(\pi\cdot\eta\cdot\gamma)) \quad (9)$$

In the formulas (6) to (9), D is the maximum Feret diameter of the CMB domains, C is a constant, a is the interfacial tension, ηm is the matrix viscosity, ηd is the domain viscosity, γ is the shear rate, and η is the viscosity of a mixed system, P is the collision coalescence probability, φ is the domain phase volume, and EDK is the domain phase cutting energy.

Regarding the requirements (A) and (B), it is effective to reduce the domain diameter according to the formulas (6) to (9) in order to improve the uniformity of interdomain distance. Further, in the process in which the raw material rubber of the domains is split and the particle diameter thereof is gradually reduced in the step of kneading MRC and CMB, the interdomain distance changes depending on when the kneading step is stopped.

Therefore, the uniformity of the interdomain distance can be controlled by the kneading time in the kneading process and the kneading rotation speed that is an index of kneading intensity. The longer the kneading time and kneading rotation speed, the more uniform the interdomain distance can be.

Method for Confirming Matrix-Domain Structure

The presence of the matrix-domain structure in the conductive layer can be confirmed by preparing a thin piece from the conductive layer and observing the fracture surface formed on the thin piece in detail. The specific procedure will be described hereinbelow.

The requirement (C) is described hereinbelow.

The present inventors have found that the above problems can be effectively resolved for the first time by using an electrophotographic apparatus equipped with a specific conductive member as described above and a specific toner described below.

The toner according to the present disclosure will be described hereinbelow.

In order not to cause the above problems, it is preferable that the deterioration of the toner be suppressed and that the charging uniformity of the conductive member be not affected even if the migrated silica fine particle adhere to the conductive member.

The toner comprises a toner particle containing a binder resin, and fine particle A and fine particle B both on the surface of the toner particle.

The fine particle A has the volume resistivity R1 of $1.0\times10^3$ to $1.0\times10^{10}$ Ω·cm.

Where the volume resistivity R1 is less than $1.0\times10^3$ Ω·cm, the toner is unlikely to maintain an appropriate charging force, and for example, fogging is likely to occur in a high-temperature and high-humidity environment.

Where the volume resistivity R1 is larger than $1.0\times10^{10}$ Ω·cm, the toner is likely to be charged up, and for example, fogging is likely to occur in a low-temperature and low-humidity environment.

Further, where the volume resistivity R1 is larger than $1.0\times10^{10}$ Ω·cm, when the fine particle A adhere to the domains exposed at the outer surface of the conductive member, the movement of charges from the discharge site is hindered. Therefore, the charging ability can be easily degraded and the charging uniformity is easily hindered. As a result, roughening of the halftone image is likely to occur.

The fine particle A preferably has the volume resistivity R1 of $1.0\times10^{4}$ to $1.0\times10^{10}$ Ω·cm, and more preferably from $1.0\times10^{5}$ to $1.0\times10^{10}$ Ω·cm.

The fine particle A can be used without particular limitation as long as the volume resistivity thereof is from $1.0\times10^{3}$ Ω·cm to $1.0\times10^{10}$ Ω·cm. The fine particle A may be inorganic fine particle. Further, the fine particle A may be inorganic fine particle containing a metal element. Further, the metal element may be titanium, aluminum, or the like.

Among them, the fine particle A may comprises at least one kind fine particle selected from the group consisting of titanium oxide fine particle, strontium titanate fine particle, and alumina fine particle.

Further, it is preferable that fine particle of at least one kind selected from the group consisting of titanium oxide fine particle and strontium titanate fine particle be contained.

It is also possible to use composite oxide fine particle including two or more kinds of metal elements. Further, fine particle of one kind or two or more kinds selected from arbitrary combination of these fine particle can be used. When the fine particle A include two or more kinds of fine particle, the volume resistivity of each kind may be from $1.0\times10^{3}$ Ω·cm to $1.0\times10^{10}$ Ω·cm.

The volume resistivity R1 of the fine particle A can be controlled by adjusting the number average particle diameter of the primary particles of the fine particle A, or by performing the hydrophobic treatment and adjusting, as appropriate, the kind and amount of the hydrophobic treatment agent used for the hydrophobic treatment.

The surface of the fine particle A may be hydrophobized with a hydrophobizing agent for the purpose of imparting hydrophobicity.

Examples of the hydrophobic agent are listed hereinbelow.

Chlorosilanes such as methyltrichlorosilane, dimethyldichlorosilane, trimethylchlorosilane, phenyltrichlorosilane, diphenyldichlorosilane, t-butyldimethylchlorosilane, vinyltrichlorosilane, and the like.

Alkoxysilanes such as tetramethoxysilane, methyltrimethoxysilane, dimethyldimethoxysilane, phenyhrimethoxysilane, diphenyldimethoxysilane, o-methylphenyhrimethoxysilane, p-mcthylphenyltrimethoxysilane, n-butyltrimethoxysilane, i-butyltrimethoxysilane, hexyltrimethoxysilane, octyhrimethoxysilane, decyltrimethoxysilane, dodecyhrimthoxysilane, tetraethoxysilane, methyhriethoxysilane, dimthyldiethoxysilane, phenyltriethoxysilane, diphenyldiethoxysilane, i-butyhriethoxysilane, decyltriethoxysilane, vinyltricthoxysilanc, γ-methacryloxypropyhrimethoxysilane, γ-glycidoxypropyltrimethoxysilane, γ-glycidoxypropylmethyldimcthoxysilane, γ-mercaptopropyhrimethoxysilane, γ-chloropropyhrimcthoxysilane, γ-aminopropyltrimethoxysilane, γ-aminopropyltricthoxysilane, γ-(2-aminoethyl)aminopropyltrimethoxysilane, γ-(2-aminoethyl) aminopropylmethyldimethoxysilane, and the like.

Silazanes such as hexamethyldisilazane, hexathyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, dimethyhetravinyldisilazane, and the like.

Silicone oils such as dimethyl silicone oil, methyl hydrogen silicone oil, methylphenyl silicone oil, alkyl-modified silicone oil, chloroalkyl-modified silicone oil, chlorophenyl-modified silicone oil, fatty acid-modified silicone oil, polyether-modified silicone oil, alkoxy-modified silicone oil, carbinol-modified silicone oil, amino-modified silicone oils, fluorine-modified silicone oils, end-reactive silicone oils, and the like.

Siloxanes such as hexamethylcyclotrisiloxane, octamethylcyclotetrasiloxane, decamethylcyclopentasiboxane, hexamethyldisiloxane, octamethyltrisiloxane, and the like.

Examples of fatty acids and metal salts include long-chain fatty acids such as undecyl acid, lauric acid, tridecyl acid, dodecyl acid, myristic acid, palmitic acid, pentadecyl acid, stearic acid, heptadecyl acid, arachidic acid, montanic acid, oleic acid, linoleic acid, arachidonic acid, and the like, and salts of these fatty acids with metals such as zinc, iron, magnesium, aluminum, calcium, sodium, lithium, and the like.

Among these, alkoxysilanes, silazanes, and silicone oils are preferably used because hydrophobization is easily performed. These hydrophobizing agents may be used singly or in combination of two or more.

The amount of the fine particles A in the toner is preferably from 0.1 part by mass to 3.0 parts by mass with respect to 100 parts by mass of the toner particles. This makes it possible to maintain good transferability through long-term use.

Further, by setting the amount of the fine particles A in the above range, it is easy to suppress the charge leak at the time of charge-up, and it is easy to maintain the appropriate charging ability of the toner and to suppress the decrease in image density.

The amount of the fine particles A in the toner is preferably from 0.3 parts by mass to 2.5 parts by mass, and more preferably from 0.5 parts by mass to 2.0 parts by mass with respect to 100 parts by mass of the toner particles.

The fine particle A preferably has a primary particle having a number average particle diameter L1 of 10 to 300 nm, and more preferably from 15 to 100 nm. When the number average particle diameter L1 of the primary particle of the fine particle A is in the above range, the particles are likely to function as leak sites during charge-up.

The fine particle B is silica fine particle.

Further, the fine particle B has the volume resistivity R2 of $1.0\times10^{11}$ to $1.0\times10^{17}$ Ω·cm.

The fine particle B preferably has the volume resistivity R2 of $1.0\times10^{12}$ to $1.0\times10^{16}$ Ω·cm.

Where the fine particle B has the volume resistivity R2 of less than $1.0\times10^{11}$ Ω·cm, the ability to provide charges to the toner may be lower than the appropriate range. Therefore, fogging easily occurs in a high-humidity and high-temperature environment. Furthermore, where the particles adhere to the matrix of the conductive member, the charge from the discharge sites of the domains may move to the fine particle B, and the charge tends to vary.

Meanwhile, when the volume resistivity of the fine particle B exceeds $1.0\times10^{17}$ Ω·cm, the toner is likely to be charged up and regulation defects are likely to occur.

The volume resistivity R2 of the fine particle B can be controlled by adjusting the number average particle diameter of the primary particles of the fine particle B, or by performing the hydrophobic treatment and adjusting, as appropriate, the kind and amount of the hydrophobic treatment agent used for the hydrophobic treatment.

The fine particle B preferably has a primary particle having a number average particle diameter L2 of S to 350 nm, more preferably from 5 to 200 nm, and even more preferably from 10 to 150 nm.

When the number average particle diameter L2 of the primary particle of the fine particle B is in the above range, the frequency of collision between the toner particles and the fine particle B tends to be higher than that between the fine particle B during the external additive mixing process, and the coverage ratio and the embedding of the additive become easier to control.

The surface of the fine particle B may be hydrophobized with a hydrophobizing agent for the purpose of imparting hydrophobicity or imparting hydrophobicity and flowability. As the hydrophobic treatment agent, those exemplified as the hydrophobic treatment agent for the fine particle A may be used.

When silicone oil is used as the hydrophobizing agent, it is preferable to use one having a viscosity of from 30 $mm^2/s$ to 1000 $mm^2$ at 25° C.

Examples include dimethyl silicone oil, methylphenyl silicone oil, α-methylstyrene-modified silicone oil, chlorophenyl silicone oil, and fluorine-modified silicone oil.

Examples of the method for hydrophobizing using silicone oil include a method of spraying silicone oil onto the silica fine particle serving as a base, and a method of dissolving or dispersing silicone oil in an appropriate solvent and then adding silica fine particle and mixing to remove the solvent.

The surface coating of the silica fine particle that have been hydrophobized with silicone oil may be stabilized by heating the silica fine particle to a temperature of 200° C. or higher (more preferably 250° C. or higher) in an inert gas after the treatment with the silicone oil.

The fine particle B is silica fine particle. Silica fine particle obtained by a dry method, such as fumed silica produced by vapor phase oxidation of a silicon halogen compound, and those obtained by a wet method such as a sol-gel method may be used. From the viewpoint of charging performance, it is preferable to use the particles obtained by the dry method.

The volume resistivity R2 of the fine particle B is preferably 1.0×10 times or more the volume resistivity R1 of the fine particle A. Further, the R2 is preferably $1.0\times10^4$ times or more, $1.0\times10^5$ times or more, and 1.0×10 times or more the R1. Further, the R2 is preferably $1.0\times10^{20}$ times or less and $1.0\times10^{18}$ times or less the R1. The numerical ranges can be arbitrarily combined.

The matrix includes almost no electronic conductive agent such as carbon black, and has higher volume resistivity than domains. The volume resistivity Rm of the matrix is $1.0\times10^5$ times or more the volume resistivity Rd of the domains. Setting the relationship between Rm and Rd within the above range is effective from the viewpoint of forming a conductive path of the domains.

Meanwhile, the fine particle A migrated from the toner have a volume resistivity close to that of the domains, and are more positively charged than the fine particle B, so that they easily adhere to the domains. Even if the fine particle A are accumulated in the domain portion as a result of repeated use for a long time, since the volume resistivity is close to that of the domains, and charging ability can be maintained without hindering the movement of charges.

In order to improve the performance of the toner, the toner may include a conventionally known external additive in addition to the fine particle A and the fine particle B as long as the effects of the above disclosure are not impaired.

The number average particle diameter L2 (nm) of the primary particle of the fine particle B and the arithmetic mean value Lws (nm) of the distances between the adjacent wall surfaces of the domains in the conductive layer when observing the outer surface of the conductive member preferably satisfy the relationship of L2<Lws.

Where this relationship is satisfied, it is possible to maintain the charging ability even after repeated use for a long time.

Further, L2 and Lws preferably satisfy the relationship of 100<Lws−L2<4000, and more preferably satisfy the relationship of 200<Lws−L2<4000.

The arithmetic average value Lws (nm) of the distance between the adjacent wall surfaces of the domains in the conductive layer when observing the outer surface of the conductive member is preferably from 100 nm to 5000 nm, and more preferably from 200 nm to 1500 nm.

The volume resistivity Rd (Ω·cm) of the domains and the volume resistivity R1 (Ω·cm) of the fine particle A preferably satisfy the relationship of the following formula (1), and more preferably satisfy the relationship of the following formula (1)':

$$1.0\times10^{-1}\leq R1/Rd\leq1.0\times10^{7} \quad (1)$$

$$1.0\times10^{4}\leq R1/Rd\leq1.0\times10^{7} \quad (1)'.$$

By satisfying the above relationship, fogging will be improved in repeated used.

A method for producing the toner particles is not particularly limited, and known means can be used.

For example, a kneading and pulverizing method or a wet production method can be used. From the viewpoint of uniformizing the particle diameter of toner particles and controlling the shape, a wet production method is preferably used. Examples of the wet production method include a suspension polymerization method, a dissolution suspension method, an emulsion polymerization aggregation method, an emulsion aggregation method, and the like.

For example, a method of producing toner particles using the emulsion aggregation method will be described hereinbelow.

Materials such as fine particle of a binder resin and, if necessary, fine particle of a release agent (for example, wax) and fine particle of a colorant are dispersed and mixed in an aqueous medium. A dispersion stabilizer or a surfactant may be added to the aqueous medium. After that, an aggregating agent is added to aggregate the toner particles until the toner particles have a desired particle diameter, thereby obtaining aggregated particles. After that or simultaneously with aggregation, fusion between the fine particle of the binder resin is performed. Further, if necessary, shape control by heat is performed to form toner particles.

Here, the fine particle of the binder resin may be composite particles formed of a plurality of layers having two or more layers made of resins having different compositions. For example, the fine particle can be produced by an emulsion polymerization method, a mini-emulsion polymerization method, a phase inversion emulsification method, and the like, or a combination of several production methods.

When the toner particle includes an internal additive such as a release agent (for example, a wax) or a colorant, the internal additive may be included in the resin fine particle. It is also possible to prepare separately a dispersion liquid of the internal additive fine particle including only the internal additive and to aggregate the internal additive fine particle and the resin fine particle together in the course of aggregation. Further, it is also possible to produce toner particles having a layered configuration of different compositions by adding and aggregating resin fine particle having different compositions at the time of aggregation.

The following compounds can be used as the dispersion stabilizer.

Examples of the inorganic dispersion stabilizer include tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina.

Examples of the organic dispersion stabilizer include polyvinyl alcohol, gelatin, methyl cellulose, methyl hydroxypropyl cellulose, ethyl cellulose, sodium salt of carboxymethyl cellulose, and starch.

As the surfactant, known cationic surfactants, anionic surfactants and nonionic surfactants can be used.

Examples of cationic surfactants include dodecyl ammonium bromide, dodecyl trimethyl ammonium bromide, dodecyl pyridinium chloride, dodecyl pyridinium bromide, hexadecyl trimethyl ammonium bromide, and the like.

Examples of nonionic surfactants include dodecyl polyoxyethylene ether, hexadecyl polyoxyethylene ether, nonylphenyl polyoxyethylene ether, lauryl polyoxyethylene ether, sorbitan monooleate polyoxyethylene ether, styrylphenyl polyoxyethylene ether, monodecanoyl sucrose, and the like.

Examples of anionic surfactants include aliphatic soaps such as sodium stearate, sodium laurate, and the like, sodium lauryl sulfate, sodium dodecylbenzenesulfonate, and sodium polyoxyethylene (2) lauryl ether sulfate, and the like.

The binder resin that constitutes the toner particle will be explained hereinbelow.

Preferable examples of the binder resin include vinyl resins and polyester resins.

Examples of vinyl resins, polyester resins, and other binder resins include the following resins or polymers.

Homopolymers of styrene and substitution products thereof such as polystyrene, polyvinyltoluene, and the like; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleic acid ester copolymer, and the like; polymethyl methacrylate, polybutyl methacrylate, polyvinyl acetate, polyethylene, polypropylene, polyvinyl butyral, polyester resins, silicone resins, polyamide resins, epoxy resins, polyacrylic resins, rosin, modified rosin, terpene resins, phenol resins, aliphatic or alicyclic hydrocarbon resins, and aromatic petroleum resins. These binder resins may be used alone or in combination of two or more.

The binder resin preferably includes a carboxy group, and is preferably a resin produced using a polymerizable monomer including a carboxy group. Examples include vinylcarboxylic acids such as acrylic acid, methacrylic acid, α-ethylacrylic acid, crotonic acid, and the like; unsaturated dicarboxylic acids such as fumaric acid, maleic acid, citraconic acid, itaconic acid, and the like; unsaturated dicarboxylic acid monoester derivatives such as succinic acid monoacryloyloxyethyl esters, succinic acid monoacryloyloxyethyl esters, phthalic acid monoacryloyloxyethyl esters, phthalic acid monomethacryloyloxyethyl esters, and the like; and the like.

Polycondensation products of the following carboxylic acid components and alcohol components can be used as the polyester resins.

Examples of carboxylic acid components include terephthalic acid, isophthalic acid, phthalic acid, fumaric acid, maleic acid, cyclohexanedicarboxylic acid, and trimellitic acid.

Examples of alcohol components include bisphenol A, hydrogenated bisphenol, ethylene oxide adduct of bisphenol A, propylene oxide adduct of bisphenol A, glycerin, trimethylolpropane, and pentaerythritol.

Also, the polyester resin may be a urea group-containing polyester resin. A polyester resin in which a carboxy group of a terminal etc. is not capped is preferred.

In order to control the molecular weight of the binder resin that constitutes the toner particle, a crosslinking agent may be added during the polymerization of the polymerizable monomer.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, neopentyl glycol diacrylate, divinylbenzene, bis(4-acryboxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester type diacrylate (MANDA, Nippon Kayaku Co., Ltd.), and compounds obtained by converting the above acrylates to methacrylates.

The addition amount of the crosslinking agent is preferably from 0.001 part by mass to 15.000 parts by mass with respect to 100 parts by mass of the polymerizable monomer.

The toner particles may include a release agent. In particular, where an ester wax having a melting point of from 60° C. to 90° C. (more preferably from 60° C. to 80° C.) is used as a release agent, the compatibility with the binder resin is excellent, so that a plasticizing effect is easily obtained and the fine particle B can be efficiently embedded in the particle surface.

Examples of the ester waxes include waxes having a fatty acid ester as a main component, such as carnauba wax, montanic acid ester wax, and the like; waxes obtained by partial or complete removal of acid component from fatty acid esters, such as deoxidized carnauba wax; methyl ester compounds having a hydroxy group that are obtained by hydrogenation and the like of vegetable oils; saturated fatty acid monoesters such as stearyl stearate, behenyl behenate, and the like; diesters of saturated aliphatic dicarboxylic acids and saturated aliphatic alcohols, such as dibehenyl sebacate, distearyl dodecanedioate, distearyl octadecanedioate, and the like; and diesters of saturated aliphatic diols and saturated aliphatic monocarboxylic acids, such as nonanediol dibehenate, dodecanediol distearate, and the like.

Among these waxes, it is preferable that a bifunctional ester wax (diester) having two ester bonds in a molecular structure be contained.

The bifunctional ester wax is exemplified by an ester compound of a dihydric alcohol and an aliphatic monocarboxylic acid, or an ester compound of a divalent carboxylic acid and an aliphatic monoalcohol.

Examples of the aliphatic monocarboxylic acid, myristic acid, palmitic acid, stearic acid, arachidic acid, behenic acid, lignoceric acid, cerotic acid, montanic acid, melissic acid, oleic acid, vaccenic acid, linoleic acid, linolenic acid, and the like.

Examples of the aliphatic monoalcohol include myristyl alcohol, cetanol, stearyl alcohol, arachidyl alcohol, behenyl alcohol, tetracosanol hexacosanol, octacosanol, triacontanol, and the like.

Examples of the divalent carboxylic acids include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, tridecanedioic acid, tetradecanedioic acid, hexadecanedioic acid, octadecanedioic acid, eicosanedioic acid, phthalic acid, isophthalic acid, terephthalic acid, and the like.

Examples of the dihydric alcohols include ethylene glycol, propylene glycol, 1,3-propanediol, 1,4-butanediol, 1,5-pentanediol, 1,6-hexanediol, 1,10-decanediol, 1,12-dodecane diol, 1,14-tetradecane diol, 1,16-hexadecane diol, 1,18-octadecane diol, 1,20-eicosane diol, 1,30-tricontane diol, diethylene glycol, dipropylene glycol, 2,2,4-trimethyl-1,3-pentanediol, neopentyl glycol, 1,4-cyclohexanedimethanol, spiroglycol, 1,4-phenylene glycol, bisphenol A, hydrogenated bisphenol A, and the like.

Examples of other release agents include paraffin wax, microcrystalline wax, petroleum waxes such as petrolatum and derivatives thereof, hydrocarbon waxes obtained by the Fischer-Tropsch method and derivatives thereof, polyolefin waxes such as polyethylene and polypropylene and derivatives thereof, and higher fatty alcohols, fatty acids such as stearic acid and palmitic acid, and compounds thereof.

The amount of the release agent in the toner particle is preferably from 5.0 parts by mass to 20.0 parts by mass with respect to 100.0 parts by mass of the binder resin or the polymerizable monomer.

The toner particle may include a colorant. As the colorant, the following known colorants can be used, but the colorant is not limited thereto.

Examples of yellow pigments include yellow iron oxide, condensed azo compounds such as Navels Yellow, Naphthol Yellow S, Hansa Yellow G, Hansa Yellow 10G, Benzidine Yellow G, Benzidine Yellow GR, Quinoline Yellow Lake, Permanent Yellow NCG, Tartrazine Lake. and the like, isoindolinone compounds, anthraquinone compounds, azo metal complexes, methine compounds, and allylamide compounds. Specific examples include the following.

C. I. Pigment Yellow 12, 13, 14, 15, 17, 62, 74, 83, 93, 94, 95, 109, 110, 111, 128, 129, 147, 155, 168, and 180.

Examples of red pigments include Bengala, Permanent Red 4R, Resole Red. Pyrazolone Red, Watching Red Calcium Salt, Lake Red C, Lake Red D, Brilliant Carmine 6B, Brillant Carmine 3B, Eosin Lake, Rhodamine Lake B, Alizarin Lake, and other condensed azo compounds, diketopyrrolopyrrole compounds, anthraquinone compounds, quinacridone compounds, basic dye lake compounds, naphthol compounds, benzimidazolone compounds, thioindigo compounds and perylene compounds. Specific examples include the following.

C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

Examples of blue pigments include copper phthalocyanine compounds and their derivatives such as Alkali Blue Lake, Victoria Blue Lake, Phthalocyanine Blue, metal-free Phthalocyanine Blue, Phthalocyanine Blue Partial Chloride, Fast Sky Blue, and Indanthrene Blue BG, anthraquinone compounds, basic dye lake compounds, and the like. Specific examples include the following.

C.I. Pigment Blue 1, 7, 15, 15:1, 15:2, 15:3, 15:4, 60, 62, and 66.

Carbon black and aniline black are examples of black pigments.

These colorants may be used alone or in a mixture, and may be used in a solid solution state.

The amount of the colorant in the toner particles is preferably from 3.0 parts by mass to 15.0 parts by mass with respect to 100.0 parts by mass of the binder resin or the polymerizable monomer.

The toner particles may include a charge control agent. Known charge control agents can be used. In particular, a charge control agent having a high charging speed and capable of stably maintaining a constant charge quantity is preferable.

The following are examples of charge control agents that control toner particles to be negatively charged.

Organometallic compounds and chelate compounds such as monoazo metal compounds, acetylacetone metal compounds, compounds of metals with aromatic hydroxycarboxylic acids, aromatic dicarboxylic acids, hydroxycarboxylic acids, and dicarboxylic acids. Other examples include aromatic hydroxycarboxylic acids, aromatic mono- and polycarboxylic acids and metal salts, anhydrides or esters thereof phenol derivatives such as bisphenol, and the like. Still other examples include urea derivatives, metal-containing salicylic acid compounds, metal-containing naphthoic acid compounds, boron compounds, quaternary ammonium salts, and calixarene.

Meanwhile, examples of the charge control agents that control the toner particles to be positively charged include the following.

Nigrosine and products of nigrosine modification with fatty acid metal salts; guanidine compounds; imidazole compounds; onium salts such as quaternary ammonium salts such as tributybenzylammonium-1-hydroxy-4-naphthosulfonate and tetrabutylammonium tetrafluoroborate, and phosphonium salts which are analogs thereof, and lake pigments thereof; triphenylmethane dyes and lake pigments thereof (examples of laking agent include phosphotungstic acid, phosphomolybdic acid, phosphotungsten molybdic acid, tannic acids, lauric acid, gallic acid, ferricyanides, fcrrocyanidcs, and the like); metal salts of higher fatty acids; and resin-based charge control agents.

These charge control agents may be contained alone or in combination of two or more.

The amount of the charge control agent in the toner particles is preferably from 0.01 parts by mass to 10.00 parts by mass with respect to 100.00 parts by mass of the binder resin or the polymerizable monomer.

Electrophotographic Apparatus

The electrophotographic apparatus has the following features.

An electrophotographic apparatus comprises:

an electrophotographic photosensitive member;

a charging device for charging a surface of the electrophotographic photosensitive member; and a developing device for developing an electrostatic latent image formed on the surface of the electrophotographic photosensitive member with a toner to form a toner image on the surface of the electrophotographic photosensitive member, wherein the charging device comprises a conductive member arranged to be capable of contacting the electrophotographic photosensitive member, and the developing device comprises the toner.

The above-mentioned toner and conductive member can be adopted in the electrophotographic apparatus.

The electrophotographic apparatus may comprise an image exposure device for irradiating the surface of the electrophotographic photosensitive member with image exposure light to form an electrostatic latent image on the surface of the electrophotographic photosensitive member;

a transfer device for transferring the toner image formed on the surface of the electrophotographic photosensitive member to a recording medium; and a fixing device for fixing the toner image transferred onto the recording medium to the recording medium.

An electrophotographic apparatus according to an embodiment of the present disclosure comprises the above-mentioned conductive member.

Figure 5:
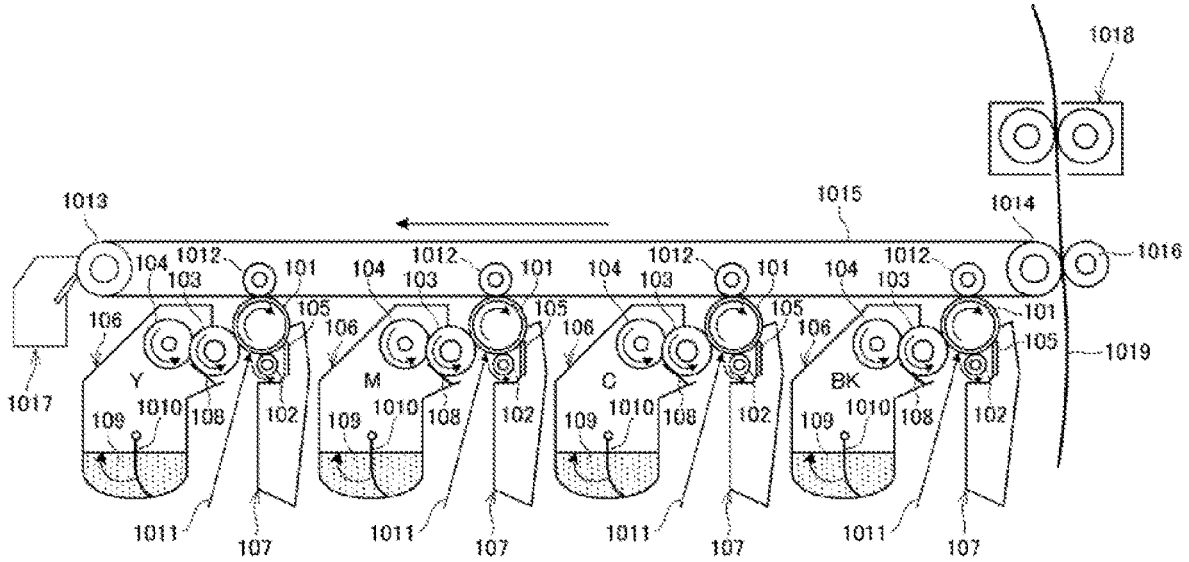
FIG. 5 is a cross-sectional schematic view of an electrophotographic apparatus.

As an example, FIG. 5 shows a schematic sectional view of an electrophotographic apparatus. This electrophotographic apparatus is a color electrophotographic apparatus including at least four electrophotographic photosensitive members (hereinafter also simply referred to as photosensitive drums), four charging devices (hereinafter simply referred to as conductive rollers) for charging the surface of the electrophotographic photosensitive members, and four developing devices (hereinafter, also simply referred to as developing rollers) for developing the electrostatic latent image formed on the surface of the electrophotographic photosensitive member with toner to form a toner image on the surface of the electrophotographic photosensitive member. Toners of black, magenta, yellow and cyan colors are supplied to respective developing rollers.

A photosensitive drum 101 rotates in the direction of the arrow and is uniformly charged by a conductive roller 102 to which a voltage is applied from a charging bias power source, and an electrostatic latent image is formed on the surface of the photosensitive drum by an exposure light 1011. Meanwhile, a toner 109 stored in a toner container 106 is supplied to a toner supply roller 104 by a stirring blade 1010 and is transported onto a developing roller 103.

Then, a developing blade 108 placed in contact with the developing roller 103 uniformly coats the toner 109 on the surface of the developing roller 103, and at the same time, charges the toner 109 by triboelectric charging. The electrostatic latent image is visualized as a toner image by developing with the toner 109 transported by the developing roller 103 placed in contact with the photosensitive drum 101.

The visualized toner image on the photosensitive drum is transferred to an intermediate transfer belt 1015, which is supported and driven by a tension roller 1013 and an intermediate transfer belt driving roller 1014, by a primary transfer roller 1012 to which a voltage is applied by a primary transfer bias power source. The toner images of the respective colors are sequentially superimposed to form a color image on the intermediate transfer belt.

A transfer material 1019 is fed into the apparatus by a paper feed roller and is transported between the intermediate transfer belt 1015 and a secondary transfer roller 1016. A voltage is applied to the secondary transfer roller 1016 from a secondary transfer bias power source, and the color image on the intermediate transfer belt 1015 is transferred onto the transfer material 1019. The transfer material 1019 onto which the color image has been transferred is fixed by a fixing device 1018 and discharged to the outside of the apparatus, thereby ending the printing operation.

Meanwhile, the untransferred toner remaining on the photosensitive drum is scraped off by a cleaning blade 105 and accommodated in the waste toner accommodation container 107, and the abovementioned steps are repeated on the cleaned photosensitive drum 101. Further, the untransferred toner remaining on the primary transfer belt is also scraped off by the cleaning device 1017.

Examples of the electrophotographic apparatus include a copying machine, a laser beam printer, an LED printer, an electrophotographic plate making system, and the like.

Process Cartridge

The process cartridge has the following features.

A process cartridge that is detachably attachable to a main body of an electrophotographic apparatus, the process cartridge comprising:

a charging device for charging a surface of an electrophotographic photosensitive member; and a developing device for developing an electrostatic latent image formed on the surface of the electrophotographic photosensitive member with a toner to form a toner image on the surface of the electrophotographic photosensitive member, wherein the developing device comprises the toner, and the charging device comprises a conductive member arranged to be capable of contacting the electrophotographic photosensitive member.

The above-mentioned toner and conductive member can be adopted in the process cartridge.

The process cartridge may have a frame for supporting the charging device and the developing device.

Figure 4:
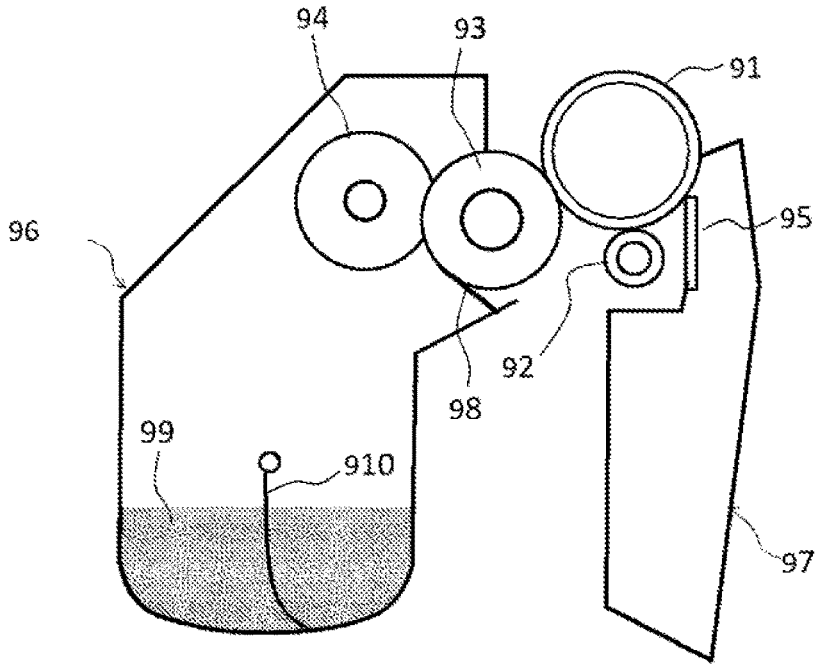
FIG. 4 is a cross-sectional schematic view of a process cartridge.

FIG. 4 is a schematic cross-sectional view of a process cartridge for electrophotography that comprises a conductive member as a conductive roller. This process cartridge has a developing device and a charging device integrated with each other, and is configured to be detachably attachable to the main body of the electrophotographic apparatus.

The developing device is provided with at least a developing roller 93 and has a toner 99. In the developing device, a toner supply roller 94, a toner container 96, a developing blade 98, and a stirring blade 910 may be integrated as needed.

The charging device may include at least a conductive roller 92, and may include a cleaning blade 95 and a waste toner container 97. Since the conductive member may be disposed so as to be able to contact the electrophotographic photosensitive member, the electrophotographic photosensitive member (photosensitive drum 91) may be integrated with the charging device as a component of the process cartridge, or may be fixedly attached to the main body as a component of the electrophotographic apparatus.

A voltage is applied to each of the conductive roller 92, the developing roller 93, the toner supply roller 94, and the developing blade 98.

Cartridge Set

The cartridge set has the following features.

A cartridge set that is detachably attachable to a main body of an electrophotographic apparatus and comprises a first cartridge and a second cartridge, wherein the first cartridge comprises a charging device for charging a surface of an electrophotographic photosensitive member, and a first frame for supporting the charging device, the second cartridge comprises a toner container that accommodates a toner for developing an electrostatic latent image formed on the surface of the electrophotographic photosensitive member to form a toner image on the surface of the electrophotographic photosensitive member, and the charging device comprises a conductive member arranged to be capable of contacting the electrophotographic photosensitive member.

The above-mentioned toner and conductive member can be adopted in the cartridge set.

Since the conductive member can be placed in contact with the electrophotographic photosensitive member, the first cartridge may include the electrophotographic photosensitive member, or the electrophotographic photosensitive member may be fixedly attached to the main body of the electrophotographic apparatus. For example, the first cartridge may have an electrophotographic photosensitive member, a charging device for charging the surface of the electrophotographic photosensitive member, and a first frame member for supporting the electrophotographic photosensitive member and the charging device. The second cartridge may include an electrophotographic photosensitive member.

The first cartridge or the second cartridge may include a developing device for forming a toner image on the surface of the electrophotographic photosensitive member. The developing device may be fixedly attached to the main body of the electrophotographic apparatus.

EXAMPLES

Hereinafter, the configurations according to the present disclosure will be described in more detail with reference to Examples and Comparative Examples, but the configurations according to the present disclosure are not limited to the configurations embodied in the Examples. Further. "parts" used in Examples and Comparative Examples are based on mass unless otherwise specified.

Production Example of Conductive Member 101

1-1. Production Example of Rubber Mixture for Domain Formation (CMB)

The materials shown in Table 1 were mixed in the compounding amounts shown in Table 1 by using a 6-liter pressure kneader (trade name: TD6-15MDX, manufactured by Toshin Co., Ltd.) to obtain the CMB. The mixing conditions were a filling rate of 70% by volume, a blade rotation speed of 30 rpm, and 30 min.

TABLE 1

| | Names of raw materials | Compounding amount (parts by mass) |
|---|---|---|
| Raw material rubber | Styrene-butadiene rubber (trade name: Tufdene 1000, manufactured by Asahi Chemical Industry Co., Ltd.) | 100 |
| Electronic conductive agent | Carbon black (trade name: Toka Black #5500, manufactured by Tokai Carbon Co., Ltd.) | 60 |

TABLE 1-continued

| | Names of raw materials | Compounding amount (parts by mass) |
|---|---|---|
| Vulcanization accelerator | Zinc oxide (trade name: Zinc White, manufactured by Sakai Chemical Industry Co., Ltd.) | 5 |
| Processing aid | Zinc stearate (trade name: SZ-2000, manufactured by Sakai Chemical Industry Co., Ltd.) | 2 |

1-2. Production Example of Matrix-Forming Rubber Mixture (MRC)

The materials shown in Table 2 were mixed in the compounding amounts shown in Table 2 by using a 6-liter pressure kneader (trade name: TD6-15MDX, manufactured by Toshin Co., Ltd.) to obtain the MRC. The mixing conditions were a filling rate of 70% by volume, a blade rotation speed of 30 rpm, and 16 min.

TABLE 2

| | Names of raw materials | Compounding amount (parts by mass) |
|---|---|---|
| Raw material rubber | Butyl rubber (trade name: JSR Butyl 065, manufactured by JSR Co., Ltd.) | 100 |
| Filler | Calcium carbonate (trade name: Nanox #30, manufactured by Maruo Calcium Co., Ltd.) | 70 |
| Vulcanization accelerator | Zinc oxide (trade name: Zinc White, manufactured by Sakai Chemical Industry Co., Ltd,) | 7 |
| Processing aid | Zinc stearate (trade name: SZ-2000, manufactured by Sakai Chemical Industry Co., Ltd.) | 2.8 |

1-3. Production Example of Unvulcanized Rubber Mixture for Forming Conductive Layer The CMB and MRC obtained above were mixed in a compounding amount shown in Table 3 by using a 6-liter pressure kneader (trade name: TD6-15MDX, manufactured by Toshin Co., Ltd.). The mixing conditions were a filling rate of 70% by volume, a blade rotation speed of 30 rpm, and 20 min.

TABLE 3

| | Names of raw materials | Compounding amount (parts by mass) |
|---|---|---|
| Raw material rubber | Domain-forming rubber mixture (CMB) | 25 |
| Raw material rubber | Matrix-forming rubber mixture (MRC) | 75 |

Then, the vulcanizing agent and vulcanization accelerator shown in Table 4 were added in the compounding amounts shown in Table 4 to 100 parts of the mixture of CMB and MRC, and mixing was performed with an open roll having a roll diameter of 12 inches (0.30 m) to prepare a rubber mixture for forming a conductive layer.

The mixing conditions were 10 rpm for the front roll rotation and 8 rpm for the rear roll rotation, a total of 20 cuts were made on the let and right with a roll gap of 2 mm, and then thinning was performed 10 times with a roll gap of 0.5 mm.

TABLE 4

| | Names of raw materials | Compounding amount (parts by mass) |
|---|---|---|
| Vulcanizing agent | Sulfur (trade name: Sulfax PMC, manufactured by Tsurumi Chemical Industry Co., Ltd.) | 3 |
| Vulcanization accelerator | Tetramethylthiuram disulfide (trade name Nocceler TT-P, manufactured by Ouchi Shinko Chemical Industrial Co., Ltd.) | 3 |

2. Fabrication of Conductive Member 2-1. Preparation of Support Having Conductive Outer Surface A round bar having a total length of 252 mm and an outer diameter of 6 mm which was obtained by subjecting the surface of stainless steel (SUS) to electroless nickel plating was prepared as a support having a conductive outer surface.

2-2. Production Example of Conductive Layer

A die with an inner diameter of 12.5 mm was attached to the tip of a crosshead extruder having a support supply mechanism and an unvulcanized rubber roller discharge mechanism, the temperature of the extruder and the crosshead was set to 80° C. and the transport speed of the support was adjusted to 60 mm/cc. Under these conditions, the conductive layer-forming rubber mixture was supplied from the extruder, and the outer peripheral portion of the support was covered with the conductive layer-forming rubber mixture in the crosshead to obtain an unvulcanized rubber roller.

Next, the unvulcanized rubber roller was placed in a hot air vulcanizing furnace at 160° C. and heated for 60 min to vulcanize the rubber mixture for forming a conductive layer and obtain a roller in which a conductive layer was formed on the outer peripheral portion of the support. After that, both end portions of the conductive layer were cut off by 10 mm each to obtain a length of the conductive layer portion in the longitudinal direction of 232 mm.

Finally, the surface of the conductive layer was polished with a rotating grindstone. Thus, a crown-shaped conductive member 1 which had a diameter of the central portion of 8.50 mm and a diameter at each position of 90 mm from the central portion to both end sides of 8.44 mm was obtained.

Production Examples of Conductive Members 2 to 5 and Conductive Members 7 and 8

Conductive members 2 to 5 and conductive members 7 and 8 were produced is the same manner as the conductive member 1 except that the materials and conditions shown in Tables 5A-1 and 5A-2 were used for the raw material rubber, electronic conductive agent, vulcanizing agent, and vulcanization accelerator.

For details of the materials shown in Tables 5A-1 to 5A-2, refer to Table 5B-1 for raw rubber, Table 5B-2 for electronic conductive agent, and Table 5B-3 for vulcanizing agent and vulcanization accelerator.

TABLE 5A-1

| | | | Domain-toning rubber mixture (CMB) | | | | | | | | |
|---|---|---|---|---|---|---|---|---|---|---|---|
| Conductive | Conductive support | | Raw material rubber | | | | Electronic conductive agent | | Dispersion | | |
| member No. | Type | Support surface | Abbreviated material name | | SP value | Mooney viscosity | Type | Parts by mass | DBP | time min | Mooney viscosity |
| 1 | SUS | Ni-plated | SBR | T1000 | 16.8 | 45 | #5500 | 60 | 155 | 30 | 84 |
| 2 | SUS | Ni-plated | EPDM | Esplene505A | 16.0 | 47 | #5500 | 65 | 155 | 30 | 94 |
| 3 | SUS | Ni-plated | Butyl | JSR Butyl 065 | 15.8 | 32 | #5500 | 65 | 155 | 30 | 93 |
| 4 | SUS | Ni-ptaled | SBR | T1000 | 16.8 | 45 | #7360 | 38 | 87 | 60 | 60 |
| 5 | SUS | Ni-plated | NBR | N202S | 20.4 | 57 | #7360 | 60 | 87 | 30 | 86 |
| 6 | SUS | Ni-plated | NBR | N230SV | 19.2 | 32 | LV | 3 | — | 30 | 35 |
| 7 | SUS | Ni-plated | BR | JSR T0700 | 17.1 | 43 | #7360 | 80 | 87 | 30 | 85 |
| 8 | SUS | Ni-plated | NBR | N202S | 20.4 | 57 | #7360 | 60 | 87 | 30 | 86 |

In the table,

DBP represents DBP oil absorption, and the unit is ($cm^3$/100 g).

Regarding the Mooney viscosity in the table, the raw material rubber values are the catalog values of each company. The CMB value is the Mooney viscosity ML (1+4) based on JIS K6300-1:2013, and is measured at the rubber temperature when all the materials constituting the CMB are kneaded.

The unit of the SP value is $(J/cm^3)^{0.5}$.

TABLE 5A-2

| | Matrix-forming rubber mixture (MRC) | | | | | | | Unvulcanized rubber mixture | | Dispersion conditions | | Vulcanizing agent | | Vulcanization accelerator | |
|---|---|---|---|---|---|---|---|---|---|---|---|---|---|---|---|
| | Raw material rubber | | | | Electronic conductive agent | | | | | | | | | | |
| Conductive member No. | Abbreviated material name | | SP value | Mooney viscosity | Type | Parts by mass | Mooney viscosity | CMB Parts by mass | MCR Parts by mass | Rotation speed min | Kneading time min | Abbreviated material name | Parts by mass | Abbreviated material name | Parts by mass |
| 1 | Butyl | JSR Butyl 065 | 15.8 | 32 | — | — | 40 | 25 | 75 | 30 | 20 | Sulfur | 3 | TT | 3 |
| 2 | SBR | T2003 | 17.0 | 33 | — | — | 53 | 25 | 75 | 30 | 20 | Sulfur | 3 | TET | 1 |
| 3 | SBR | T2003 | 17.0 | 33 | — | — | 52 | 24 | 75 | 30 | 20 | Sulfur | 2 | TT | 2 |
| 4 | SBR | A303 | 17.0 | 46 | — | — | 52 | 22 | 75 | 30 | 20 | Sulfur | 2 | TT | 2 |
| 5 | EPDM | Esplene505A | 16.0 | 47 | — | — | 52 | 25 | 75 | 30 | 5 | Sulfur | 3 | TET | 3 |
| 6 | — | — | — | — | — | — | — | 100 | 0 | — | — | Sulfur | 3 | TBZTD | 1 |
| 7 | NBR | N230SV | 19.2 | 32 | — | — | 37 | 25 | 75 | 30 | 20 | Sulfur | 3 | TBZTD | 1 |
| 8 | ECD | CG103 | 18.5 | 64 | — | — | 21 | 20 | 80 | 20 | 20 | Sulfur | 3 | TBZTD | 1 |

Regarding the Mooney viscosity in the table, the raw material rubber values are the catalog values of each company. The MRC value is the Mooney viscosity ML (1+4) based on JIS K6300-1:2013, and is measured at the rubber temperature when all the materials constituting the CMB are kneaded.

The unit of SP value is $(J/cm^3)^{0.5}$.

TABLE 5B-1

| Abbreviated material name | | Material name | Product name | Manufacturer name |
|---|---|---|---|---|
| Butyl | Butyl065 | Butyl rubber | JSR Butyl 065 | JSR Corp. |
| BR | T0700 | Polybutadiene rubber | JSR T0700 | JSR Corp. |
| ECO | CG103 | Epichlorohydrin rubber | Epichiomer CG103 | Osaka Soda Co., Ltd. |
| EPDM | Esplene301A | Ethylene-propylene-diene rubber | Esprene301A | Sumitomo Chemical Co., Ltd. |
| EPDM | Esplene505A | Ethylene-propylene-diene rubber | Esprene505A | Sumitomo Chemical Co., Ltd. |
| NBR | DN401LL | Acrylonitrile butadiene rubber | Nipol DN401LL | Zeon Corporation |
| NBR | N230SV | Acrylonitrile butadiene rubber | NBR M230SV | JSR Corp. |
| NBR | N230S | Acrylonitrile butadiene rubber | NBR N230S | JSR Corp. |
| NBR | N202S | Acrylonitrile butadiene rubber | NBR N202S | JSR Corp. |
| SBR | T2003 | Styrene butadiene rubber | Tufdene2003 | Asahi Chemical Industry Co., Ltd. |
| SBR | T1000 | Styrene butadiene rubber | Tufdene1000 | Asahi Chemical Industry Co., Ltd. |
| SBR | T2100 | Styrene butadiene rubber | Tufdene2100 | Asahi Chemical Industry Co., Ltd. |
| SBR | A303 | Styrene butadiene rubber | Asaprene303 | Asahi Chemical industry Co., Ltd. |

TABLE 5B-2

| Abbreviated material name | Material name | Productname | Manufacturer name |
|---|---|---|---|
| #7360 | Conductive carbon black | Toka Black #7360SB | Tokai Carbon Co., Ltd. |
| #5500 | Conductive carbon black | Toka Black #5500 | Tokai Carbon Co., Ltd. |
| Ketjen | Conductive carbon black | Carbon ECP | Lion Specialty Chemicals Co., Ltd, |
| LV | Ionic conductor | LV70 | ADEKA |

TABLE 5B-3

| Abbreviated material name | Material name | Product name | Manufacturer name |
|---|---|---|---|
| Sulfur | Sulfur | Sulfax PMC | Tsurumi Chemical Industry Co., Ltd. |
| TT | Tetramethylthiuram disulfide | Nocceler TT-P | Ouch Shinko Chemical Industrial Co., Ltd. |
| TBZTD | Tetramethylthiuram disulfide | Sanceler TBZTD | Sanshin Chemical Industry Co., Ltd. |
| TET | Tetraethylthiuram disulfide | Sanceler TET-G | Sanshin Chemical Industry Co., Ltd. |

Production Example of Conductive Member 6

A round bar having a total length of 252 mm and an outer diameter of 6 mm which was obtained by subjecting the surface of stainless steel (SUS) to electroless nickel plating was prepared as a support having a conductive outer surface. Next, a conductive member 6A was manufactured in the same manner as the conductive member 1 except that the materials and conditions shown in Table 5A-1 and Table 5A-2 were used.

Next, according to the following method, a conductive resin layer was further provided on the conductive member 6A to produce a conductive member 6.

First, methyl isobutyl ketone was added as a solvent to a caprolactone-modified acrylic polyol solution to adjust the solid content to 10% by mass. For 1000 parts of this acrylic polyol solution (100 parts of solid content), a mixed solution was prepared using the materials shown in Table 6 below. At this time, the mixture of the block HDI and the block IPD was "NCO/OH=1.0".

TABLE 6

| | Raw material name | Compounded amount parts by mass |
|---|---|---|
| Main agent | Caprolactone-modified acrylic polyol solution (solid content 70%) (trade name: PLACCEL DC2016, manufactured by Daicel Corp.) | 100 (Solid content) |
| Curing agent 1 | Block isocyanate A (IPDI, solid content: 60%) (trade name: VEST ANAT B1370, manufactured by Degussa Japan Co., Ltd.) | 37 (Solid content) |
| Curing agent 2 | Block isocyanate B (HDI, solid content 80%) (trade name: DURANATE TPA-B80E, manufactured by Asahi Kasei Chemicals Corp.) | 24 (Solid content) |
| Conductive agent | Carbon black (HAF) (trade name: Seast3, manufactured by Tokai Carbon Co., Ltd.) | 15 |

TABLE 6-continued

| | Raw material name | Compounded amount parts by mass |
|---|---|---|
| Additive 1 | Needle-shaped rutile-type titanium oxide fine particles (trade name: MT-100T, manufactured by Tayca Corp.) | 35 |
| Additive 2 | Modified dimethyl silicone oil (trade name: SH 28PA, manufactured by Toray Dow Corning Silicone Co., Ltd.) | 0.1 |

Then, 210 parts of the mixed solution and 200 parts of glass beads having an average particle diameter of 0.8 mm as media were mixed in a 450 mL glass bottle and pre-dispersed for 24 h using a paint shaker disperser to obtain a coating material for forming a conductive resin layer.

The conductive member 6A was coated by a dipping method by dipping in the coating material for forming a conductive resin layer with the longitudinal direction of the conductive member being the vertical direction. The dipping coating immersion time was 9 sec, the initial pull-up speed was 20 mm/sec, the final pull-up speed was 2 mm/sec, and in this process, the speed was changed linearly with time. The obtained coated product was air-dried at normal temperature for 30 min, then dried for 1 h in a hot-air circulation dryer set at 90° C., and further dried for 1 h in a hot-air circulation dryer set at 160° C. to obtain the conductive member 6.

In the conductive member 6, the conductive layer was configured not to have a matrix-domain configuration, and thus had a single conductive path as the conductive member.

Methods for measuring physical properties related to this disclosure areas follows.

Figure 3A:
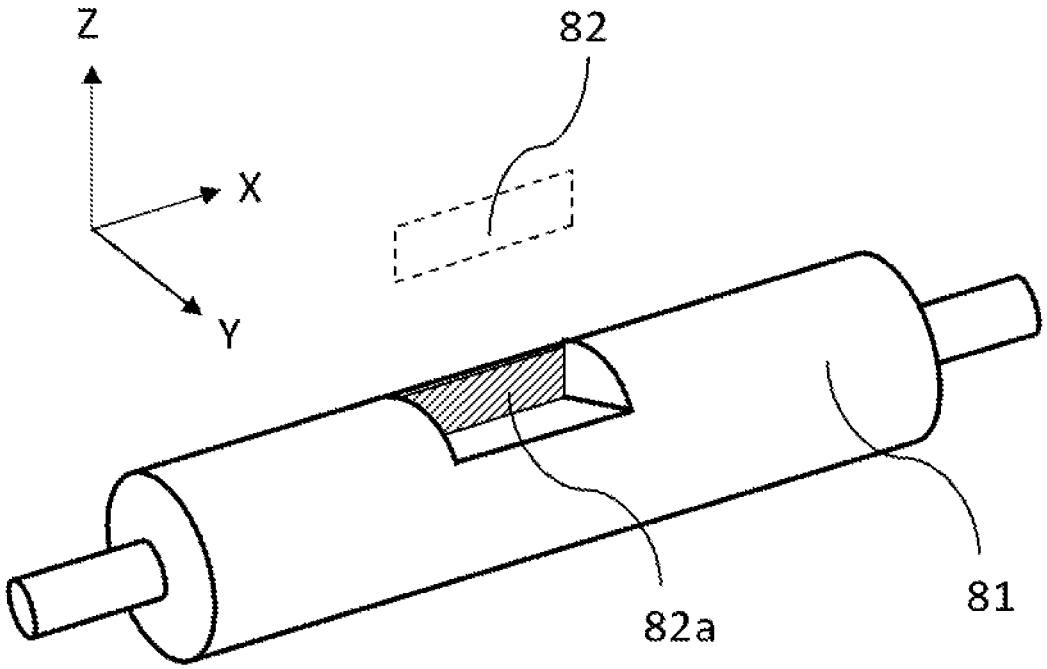
FIG. 3A is a cut-out explanatory view of the conductive member.
Figure 3B:
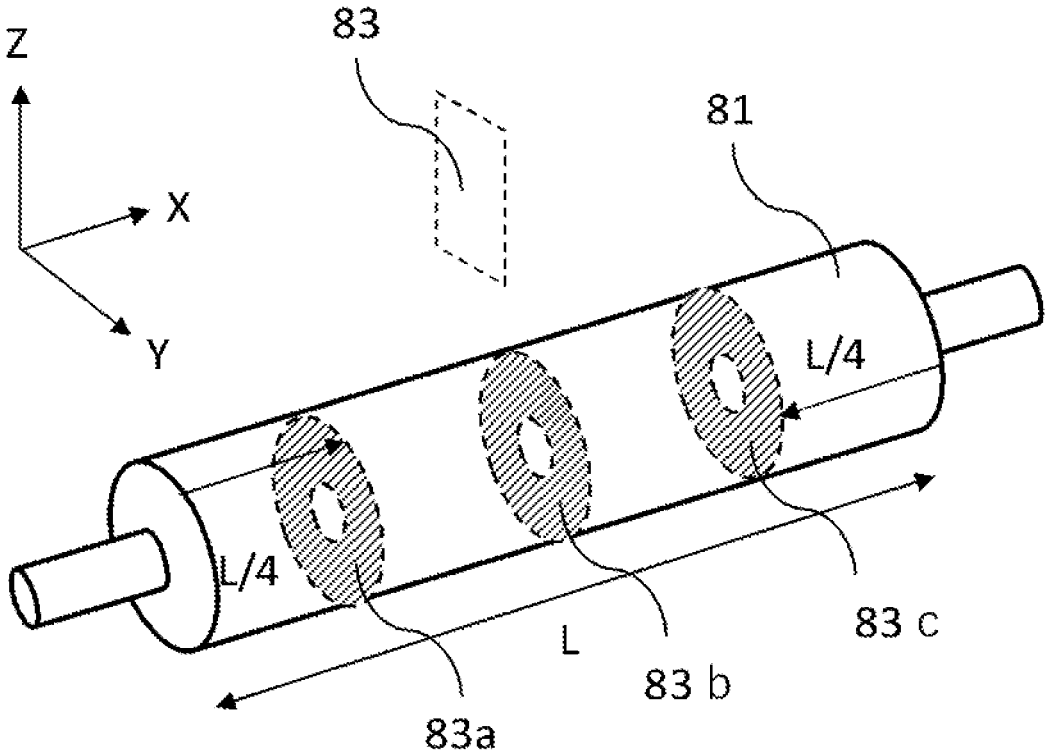
FIG. 3B is an explanatory view in a cross-section cut-out direction.

FIGS. 3A and 3B show the shape of the conductive member 81 along three axes, specifically, in three dimensions along the X, Y, and Z axes. In FIGS. 3A and 3B, the X axis indicates a direction parallel to the longitudinal direction (axial direction) of the conductive member, and the Y axis and the Z axis indicate directions perpendicular to the axial direction of the conductive member.

FIG. 3A shows an image diagram of the conductive member in which the conductive member is cut at a cross section 82*a* parallel to an XZ plane 82. The XZ plane can rotate 360° about the axis of the conductive member. Considering that the conductive member rotates while being in contact with the photosensitive drum, and discharges when passing through the gap with the photosensitive drum, the cross-section 82*a* parallel to the XZ plane 82 represents a surface that is discharged simultaneously at a certain timing. The surface potential of the photosensitive drum is formed as a result of passing of a surface corresponding to a certain amount of the cross section 82*a*.

Therefore, in order to evaluate the domains that correlate with the electric field concentration in the conductive member, the evaluation may be performed at a cross section parallel to the YZ plane 83, which is perpendicular to the axial direction of the conductive member, where the domains including a certain amount of the cross section 82*a* can be evaluated, rather than by analyzing the cross section such as the cross section 82*a* at which the discharge is simultaneously generated at a certain moment.

Further, in the evaluation, a total of three locations, namely, in a cross section 83*b* at the center of the conductive layer in the longitudinal direction and in two cross sections (83*a* and 83*c*) at L/4 from both ends of the conductive layer toward the center, where L stands for the length of the conductive layer in the longitudinal direction.

Regarding the observation positions of the cross sections 83*a* to 83*c*, where the thickness of the conductive layer is denoted by T, the measurement may be performed in a total of 9 observation areas when a 15-μm quadrangular observation area is placed at each of three randomly selected locations in the thickness region from the outer surface of each slice to the depth of from 0.1T to 0.9T.

3-1. Confirmation of Matrix-Domain Structure

The formation of the matrix-domain structure in the conductive layer was confirmed by the following method.

Using a razor, a piece (thickness: 500 μm) was cut out so that a cross section orthogonal to the longitudinal direction of the conductive layer of the conductive member could be observed. Next, platinum was vapor-deposited, and a scanning electron microscope (SEM)(trade name: S-4800, manufactured by Hitachi High-Technologies Corporation) was used to capture an image at a magnification of 1,000 times to obtain a cross-sectional image.

In one embodiment, a matrix-domain structure observed in the slice from the conductive layer had a plurality of domains 6*b* dispersed in a matrix 6*a* in the cross-sectional image as shown in FIG. 2, and the domains were present independently without contacting each other. Meanwhile, the matrix was continuous in the image, and the domains were separated by the matrix.

In order to quantify the captured cross-sectional images, image processing software (trade name: ImageProPlus, manufactured by Media Cybernetics, Inc.) was used to convert the cross-sectional images obtained by SEM observation into 8-bit grayscale and obtain a monochrome image having 256 gradations. Next, after inversion processing of the black and white of the image so that the domain in the cross section became white, the threshold of binarization was set based on the algorithm of Otsu's discriminant analysis method for the luminance distribution of the image and a binarized image was obtained.

By the counting function for the binarized image, the number percentage K of isolated domains that were not connected to other domains, as described above, was calculated with respect to the total number of domains that were present in a 50 μm square area and had no contact with the frame line of the binarized image.

Specifically, in the counting function of the image processing software, the setting was made so that the domains that had contact points with the frame line of the four-direction end portions of the binarized image were not counted.

The aforementioned slices were prepared from one point randomly selected from each region obtained by equally dividing the conductive layer of the conductive member (conductive roller) into 5 parts in the longitudinal direction and equally dividing into 4 parts in the circumferential direction, that is, from a total of 20 points, and an arithmetic mean value (number %) of K when the above measurement was performed was calculated.

When the arithmetic mean value of K (number %) was 80 or more, the matrix-domain structure was evaluated as "present", and when the arithmetic mean value of K (number %) was less than 80, the evaluation was "absent".

3-2. Method for Measuring Volume Resistivity Rm of Matrix

The volume resistivity Rm of the matrix can be measured by, for example, cutting out a thin piece that has a predetermined thickness (for example, 1 μm) and includes a matrix-domain structure from the conductive layer, and bringing a microprobe of a scanning probe microscope (SPM) or an atomic force microscope (AFM) into contact with the matrix in the thin piece.

As for cutting out a thin piece from an elastic layer, for example, when the longitudinal direction of the conductive member is the X axis, the thickness direction of the conductive layer is the Z axis, and the circumferential direction is the Y axis, as shown in FIG. 3B, the thin piece is cut out so as to include at least a part of a plane parallel to the YZ plane (for example, 83*a*, 83*b*, 83*c*) perpendicular to the axial direction of the conductive member. The cutting can be performed using, for example, a sharp razor, a microtome, or a focused ion beam method (FIB).

The volume resistivity is measured by grounding one side of a thin piece cut out from the conductive layer. Then, a microprobe of a scanning probe microscope (SPM) or an atomic force microscope (AFM) is brought into contact with the matrix portion of the surface of the thin piece opposite to the ground surface, a DC voltage of 50 V is applied for 5 sec, an arithmetic mean value is calculated from the values obtained by measuring the ground current value for 5 sec, and the applied voltage is divided by the calculated value to calculate the electrical resistance value. Finally, the resistance value is converted into volume resistivity by using the film thickness of the thin piece. At this time, SPM and AFM can measure the film thickness of the thin piece at the same time as the resistance value.

The value of the volume resistivity Rm of the matrix in the columnar charging member is obtained, for example, by cutting out a sample from each area obtained by dividing the conductive layer into 4 parts in the circumferential direction and 5 parts in the longitudinal direction, obtaining the abovementioned measurement value, and calculating the arithmetic mean value of volume resistance values for a total of 20 samples.

In this example, first, a microtome (trade name: Leica EM FCS, manufactured by Leica Microsystems Inc.) was used to cut out a 1 μm-thick thin piece from the conductive layer of the conductive member at a cutting temperature of −100° C. As shown in FIG. 3B, the thin piece was cut out so as to include at least a part of an YZ plane (for example, 83*a*, 83*b*, 83*c*) perpendicular to the axial direction of the conductive member when the longitudinal direction of the conductive member was taken as X axis, the thickness direction of the conductive layer was taken as Z axis, and the circumferential direction was taken as Y axis.

In a temperature environment of 23° C. and a humidity of 50% RH, one surface of the thin piece (hereinafter, also referred to as "ground surface") was grounded on a metal plate, the surface (hereinafter, also referred to as "measurement surface") of the thin piece on the side opposite to the ground surface corresponded to the matrix, and a cantilever of a scanning probe microscope (SPM) (trade name: Q-Scope250, manufactured by Quesant Instrument Corporation) was brought into contact with a portion between the measurement surface and the ground surface where domains were not present. Subsequently, a voltage of 50 V was applied to the cantilever for 5 see, the current value was measured, and the arithmetic mean value for 5 sec was calculated.

The surface shape of the measurement thin piece was observed with the SPM, and the thickness of the measurement location was calculated from the obtained height profile. Further, the area of the recess on the contact portion of the cantilever was calculated from the observation result of the surface shape. The volume resistivity was calculated from the thickness and the area of the recess.

The measurement was performed by producing a thin piece at a random location in each of parts obtained by dividing the conductive layer into 5 parts in the longitudinal direction and 4 parts in the circumferential direction, that is, producing a total of 20 thin pieces. The average value thereof was taken as the volume resistivity Rm of the matrix.

The scanning probe microscope (SPM)(trade name: Q-Scope250, made by Quesant Instrument Corporation) was operated in a contact mode.

The evaluation results are shown in Table 7 as "Volume resistivity Rm (unit: 2-cm)" of the matrix.

3-3. Method for Measuring Volume Resistivity Rd of Domain

The volume resistivity Rd of the domains was measured by the same method as in the measurement of the volume resistivity Rm of the matrix, except that the measurement was performed at a location corresponding to the domain of an ultrathin piece and the measurement voltage was set to 1 V. In the present example, the measurement and calculation of Rd were performed in the same manner as in the above-described Method for Measuring Volume Resistivity Rm of Matrix, except that the location on the measurement surface where the cantilever was brought into contact was changed to a location which corresponded to the domain and in which the matrix was not present between the measurement surface and the ground surface, and the applied voltage at the time of measuring the current value was changed to 1 V.

The evaluation results are shown in Table 7 as "Volume resistivity Rd (unit: Ω·cm)" of the matrix.

3-4. Method for Measuring Calculated Average Value D (Domain Diameter D) of Circle-Equivalent Diameters of Domains in Conductive Layer, and Calculated Average Value Ds (Domain Diameter Ds) of Circle-Equivalent Diameters of Domains in Conductive Layer when Observing Outer Surface of Conductive Member The calculated average value D (domain diameter D) of the circle-equivalent diameter of the domains was measured in the following manner.

A microtome (trade name: Leica EM FCS, manufactured by Leica Microsystems Inc.) was used to cut out a sample with a thickness of 1 μm that had a cross section in the thickness direction of the conductive layer as shown in FIG. 3B from three locations (83*a*, 83*b*, 83*c*), namely, at the center (83*b*) in the longitudinal direction of the conductive layer and at L/4 from both ends of the conductive layer toward the center, where L stands for the length of the conductive layer in the longitudinal direction and T stands for the thickness of the conductive layer.

Platinum was vapor-deposited on the cross section in the thickness direction of the conductive layer in each of the three obtained samples.

Then, in the platinum vapor deposition surface of each sample, images of three arbitrarily selected locations within the thickness region from the outer surface of the conductive layer to the depth of from 0.1T to 0.9T were captured at a magnification of 5,000 times using a scanning electron microscope (SEM) (trade name: S-4800, manufactured by Hitachi High-Technologies Corporation).

Each of the obtained nine captured images was binarized by image processing software (product name: ImagePro-Plus; manufactured by Media Cybernetics Inc.), and quantified by a counting function to calculate the arithmetic mean value S of the area of the domains included in each captured image.

Next, the circle-equivalent diameter of the domains ($=(4S/\pi)^{0.5}$) was calculated from the arithmetic mean value S of the area of the domains calculated for each captured image. Next, the calculated average value of the circle-equivalent diameters of the domains of each captured image was calculated to obtain the calculated average value D (domain diameter D) of the circle-equivalent diameters of the domains in the conductive layer in the cross-section observation of the conductive member.

The calculated average value Ds of the circle-equivalent diameters of the domains (domain diameter Ds) was measured in the following manner.

The microtome (trade name: Leica EM FCS, manufactured by Leica Microsystems Inc.) was used to cut out a sample that included the outer surface of the conductive layer from three locations, namely, at the center in the longitudinal direction of the conductive layer and at L/4 from both ends of the conductive layer toward the center. The sample had a thickness of 1 μm.

Platinum was vapor-deposited on the surface corresponding to the outer surface of the conductive layer in the samples.

Arbitrary three locations on the platinum vapor deposition surface of the sample were selected and images thereof were captured at a magnification of 5,000 using the scanning electron microscope (SEM) (trade name: S-4800, manufactured by Hitachi High-Technologies Corporation).

Each of the obtained nine captured images was binarized by image processing software (product name: ImagePro-Plus; manufactured by Media Cybernetics Inc.), and quantified by a counting function to calculate the arithmetic mean value Ss of the flat areas of the domains included in each captured image.

Next, the circle-equivalent diameter of the domains ($=(4S/\pi)^{0.5}$ was calculated from the arithmetic mean value Ss of the flat area of the domains calculated for each captured image. Next, the calculated average value of the circle-equivalent diameters of the domains of each captured image was calculated to obtain the calculated average value Ds (domain diameter Ds) of the circle-equivalent diameters of the domains in the conductive layer in the cross-section observation of the conductive member.

3-5. Method for Measuring Arithmetic Mean Value Lw (Distance Lw Between Domains) of Distance Between Adjacent Wall Surfaces of Domains in Conductive Layer in Cross-Sectional Observation of Conductive Member and Arithmetic Mean Value Lws (Distance Lws Between Domains) of Distance Between Adjacent Wall Surfaces of Domains when Observing Outer Surface of Conductive Member A sample showing a cross section in the thickness direction of the conductive layer as shown in FIG. 3B was obtained from three locations (83*a*, 83*b*, 83*c*), namely, at the center (83*b*) in the longitudinal direction of the conductive layer and at L/4 from both ends of the conductive layer toward the center, where L stands for the length of the conductive layer in the longitudinal direction and T stands for the thickness of the conductive layer.

A 50 μm quadrangular analysis area was placed at each of three randomly selected locations in the thickness region from the outer surface of the conductive layer to the depth of 0.1T to 0.9T in the surface showing the cross section in the thickness direction of the conductive layer, and images of the three analysis areas were captured at a magnification of 5,000 times using a scanning electron microscope (SEM) (trade name: S-4800, manufactured by Hitachi High-Technologies Corporation) for each of the three samples.

Each of a total of nine obtained images was binarized using image processing software (product name: LUZEX; manufactured by Nireco Corp.).

The binarization procedure was performed in the following manner. The captured image was converted to an 8-bit grayscale to obtain a 256-tone monochromatic image. Then, the black and white of the image were inverted so that the domain in the captured image became white, and binarization was performed to obtain a binarized image of the captured image.

Next, for each of the nine binarized images, the distance between the adjacent wall surfaces of the domains was calculated, the arithmetic mean value thereof was calculated, and this value was defined as Lw.

The distance between the adjacent wall surfaces is the shortest distance between the wall surfaces of the domains that are closest to each other, and this distance can be determined by setting a measurement parameter as the distance between the adjacent wall surfaces in the above-mentioned image processing software.

Meanwhile, a sample was cutout using a razor so as to include the outer surface of the conductive member from three locations, namely, at the center in the longitudinal direction of the conductive layer and at L/4 from both ends of the conductive layer toward the center, where L stands for the length of the conductive layer in the longitudinal direction and T stands for the thickness of the conductive layer where the length of the conductive layer in the longitudinal direction is taken as L and the thickness of the conductive layer is taken as T. The size of the sample was 2 mm in the circumferential direction and the longitudinal direction of the conductive member, and the thickness was the thickness T of the conductive member.

A 50 μm quadrangular analysis area was placed at each of three randomly selected locations on the surface corresponding to the outer surface of the conductive layer, and images of the three analysis areas were captured at a magnification of 5,000 times using a scanning electron microscope (SEM) (trade name: S-4800, manufactured by Hitachi High-Technologies Corporation) for each of the three samples.

Each of a total of nine obtained images was binarized using image processing software (product name: LUZEX; manufactured by Nireco Corp.). The binarization procedure was the same as that used when obtaining the interdomain distance Lw. Next, for each of the nine binarized images, the distance between the adjacent wall surfaces of the domains was calculated, the arithmetic mean value thereof was calculated, and this value was defined as Lws.

TABLE 7

| | | Property evaluation of matrix-domain structure | | | | | | |
|---|---|---|---|---|---|---|---|---|
| | | Matrix | Domain | | | | | |
| Conductive member No. | Presence/ absence of matrix-domain structure | Volume resistivity Rm Ω · cm | Volume resistivity Rd Ω · cm | Domain diameter Ds μm | Domain diameter D μm | Interdomain distance Lw μm | Interdomain distance Lws nm | Rm/Rd — |
| 1 | Present | $5.83 \times 10^{16}$ | $1.66 \times 10^{1}$ | 0.20 | 0.20 | 0.22 | 250 | $3.5 \times 10^{15}$ |
| 2 | Present | $1.10 \times 10^{13}$ | $2.58 \times 10^{1}$ | 0.22 | 0.22 | 0.25 | 250 | $4.3 \times 10^{11}$ |
| 3 | Present | $2.62 \times 10^{12}$ | $6.23 \times 10^{1}$ | 1.20 | 1.20 | 1.22 | 1330 | $4.2 \times 10^{10}$ |
| 4 | Present | $2.09 \times 10^{12}$ | $3.08 \times 10^{6}$ | 1.78 | 1.78 | 0.44 | 450 | $6.8 \times 10^{5}$ |
| 5 | Present | $7.09 \times 10^{16}$ | $2.60 \times 10^{1}$ | 5.66 | 5.65 | 6.8 | 4100 | $2.7 \times 10^{15}$ |
| 6 | Absent | — | — | — | — | — | — | — |
| 7 | Present | $2.58 \times 10^{9}$ | $5.21 \times 10^{1}$ | 2.31 | 2.30 | 0.26 | 720 | $5.0 \times 10^{7}$ |
| 8 | Present | $6.45 \times 10^{9}$ | $3.22 \times 10^{3}$ | 1.43 | 1.42 | 1.04 | 490 | $2.0 \times 10^{4}$ |

Production Example of Toner Particle 1

Preparation of Binder Resin Fine Particle-Dispersed Solution

A total of 89.5 parts of styrene, 9.2 parts of butyl acrylate, 1.3 parts of acrylic acid, and 3.2 parts of n-lauryl mercaptan were mixed and dissolved.

An aqueous solution prepared by dissolving 1.5 parts of Neogen RK (manufactured by Daiichi Kogyo Seiyaku Co., Ltd.) in 150 parts of ion-exchanged water was added to and dispersed in the solution. An aqueous solution in which 0.3 part of potassium persulfate was dissolved in 10 parts of ion-exchanged water was further added while slowly stirring for 10 min.

After nitrogen substitution, emulsion polymerization was performed at 70° C. for 6 h. After completion of the polymerization, the reaction solution was cooled to room temperature and ion-exchanged water was added to obtain a binder resin fine particle-dispersed solution having a solid content concentration of 12.5% by mass and a volume-based median diameter of 0.2 μm.

Preparation of Release Agent-Dispersed Solution

A total of 100 parts of a release agent (behenyl behenate, melting point: 72.1° C.) and 15 parts of Neogen RK (manufactured by Daiichi Kogyo Seiyaku Co., Ltd.) were mixed with 385 parts of ion-exchanged water and dispersed for about 1 h with a wet jet mill JN100 (manufactured by Jokoh Co., Ltd.) to obtain a release agent-dispersed solution. The concentration of the release agent-dispersed solution was 20% by mass.

Preparation of Colorant-Dispersed Solution

A total of 100 parts of carbon black "Nipex 35" (manufactured by Orion Engineered Carbons Co., Ltd.) as a colorant and 15 parts of Neogen RK (manufactured by Daiichi Kogyo Seiyaku Co., Ltd.) were mixed with 885 parts of ion-exchanged water, and dispersed with the wet jet mill JN100 (manufactured by Jokoh Co., Ltd.) for about 1 h to obtain a colorant-dispersed solution.

Preparation of Toner Particles

A total of 265 parts of the binder resin fine particle-dispersed solution, 10 parts of the release agent-dispersed solution, and 10 parts of the colorant-dispersed solution were dispersed using a homogenizer (Ultra Turrax T50, manufactured by IKA).

The temperature inside the container was adjusted to 30° C. while stirring, and 1 mol/L hydrochloric acid was added to adjust the pH to 5.0.

After being allowed to stand for 3 min, the temperature rise was started and the temperature was raised to 50° C. to generate aggregated particles.

In that state, the particle diameter of the aggregated particles was measured with "Coulter Counter Multisizer 3" (registered trademark, manufactured by Beckman Coulter, Inc.). When the weight average particle diameter of the aggregated particles reached 6.2 μm, 1 mol/L sodium hydroxide aqueous solution was added to adjust the pH to 8.0 to stop the particle growth.

After that, the temperature was raised to 95° C. to fuse and spheroidize the aggregated particles. When the average circularity reached 0.980, the temperature decrease was started, and the temperature was decreased to 30° C. to obtain a toner particle-dispersed solution 1.

The obtained toner particle-dispersed solution 1 was subjected to solid-liquid separation with a pressure filter to obtain a toner cake. The toner cake was reslurried with ion-exchanged water to obtain a dispersion again, and then solid-liquid separation was performed with the abovementioned filter. The reslurry and solid-liquid separation were repeated until the electric conductivity of the filtrate became 5.0 μS/cm or less, and finally solid-liquid separation was performed to obtain a toner cake.

The obtained toner cake was dried with a flash dryer (Flash Jet Dryer, manufactured by Seishin Enterprise Co., Ltd.). The drying conditions were such that the blowing temperature was 90° C., the dryer outlet temperature was 40° C. and the toner cake supply rate was adjusted so that the outlet temperature did not deviate from 40° C. according to the water content of the toner cake.

Further, using a multi-division classifier utilizing the Coanda effect, fine and coarse powders were cut to obtain toner particles 1. The toner particles 1 had a weight average particle diameter (D4) of 6.3 μm, an average circularity of 0.980 and a glass transition temperature (Tg) of 57° C.

Production Example of Fine Particle A1

An ilmenite ore including 50% by mass of $TiO_2$ equivalent was dried at 150° C. for 3 h and then sulfuric acid was added to dissolve the ore to obtain an aqueous solution of $TiOSO_4$.

After concentrating the obtained aqueous solution, 10 parts of titania sol having rutile crystals was added as seeds to 100 parts of $TiO_2$ equivalent, followed by hydrolysis at 170° C. to obtain a $TiO(OH)_2$ slurry including impurities.

The slurry was repeatedly washed at pH 5 to 6 to sufficiently remove sulfuric acid. $FeSO_4$ and impurities, thereby obtaining a highly pure metatitanic acid [$TiO(OH)_2$] slurry.

After filtering the slurry, 0.5 part of lithium carbonate ($Li_2CO_3$) was added to 100 parts of the dry mass of the slurry, and the mixture was calcined at 250° C. for 3 h, and then repeatedly pulverized by a jet mill to obtain titanium oxide fine particle having rutile type crystals.

The obtained titanium oxide fine particle were dispersed in ethanol and stirred, and 5 parts of isobutyltrimethoxysilane as a surface treatment agent was added dropwise, mixed and reacted with 100 parts of the titanium oxide fine particle. After drying, heat treatment was performed at 170° C. for 3 h, and pulverization was repeatedly performed with a jet mill until aggregates of titanium oxide disappeared to obtain fine particle A1 (titanium oxide fine particle). Table 8 shows the physical properties of the fine particle A1.

Production Example of Fine Particle A2

After the metatitanic acid obtained by the sulfuric acid method was deironed and bleached, an aqueous sodium hydroxide solution was added to adjust the pH to 9.0, and desulfurization was performed, followed by neutralization to pH 5.8 with hydrochloric acid, filtration and washing with water. Water was added to the washed cake to make a $TiO_2$ slurry of 1.85 mol/L, and then hydrochloric acid was added to adjust the pH to 1.0 to perform peptization treatment.

A total of 1.88 mol, as $TiO_2$, of the desulfurized/peptized metatitanic acid was sampled and placed in a 3 L reaction vessel. After adding 2.16 mol of a strontium chloride aqueous solution to the peptized metatitanic acid slurry so that the Sr/Ti (molar ratio) was 1.15, the $TiO_2$ concentration was adjusted to 1.039 mol/L.

Next, after heating to 90° C. with stirring and mixing, 440 mL of a 10 mol/L sodium hydroxide aqueous solution was added over 45 min, and then stirring was continued at 95° C. for 1 h to complete the reaction.

The reaction slurry was cooled to 50° C., hydrochloric acid was added until the pH reached 5.0, and stirring was continued for 1 h. The obtained precipitate was washed by decantation.

The slurry including the precipitate was adjusted to 40° C., hydrochloric acid was added to adjust the pH to 2.5, 4.0% by mass of n-octyltriethoxysilane was added to the solid content, and stirring and holding were continued for 10 h. After adjusting the pH to 6.5 by adding a 5 mol/L sodium hydroxide solution and continuing stirring for 1 h, filtration and washing were performed, and the obtained cake was dried in the atmosphere at 120° C. for 8 h to obtain fine particle A2 (strontium titanate fine particle). Table 8 shows the physical properties of the fine particle A2.

Production Example of Fine Particle A3

A hydrous titanium oxide slurry obtained by hydrolyzing an aqueous solution of titanyl sulfate was washed with an aqueous alkaline solution. Next, hydrochloric acid was added to the slurry of hydrous titanium oxide to adjust the pH to 2.0 to obtain a titania sol-dispersed solution. NaOH was added to the titania sol-dispersed solution, the pH of the dispersion was adjusted to 5.5, and washing was repeated until the electric conductivity of the supernatant became 100 μS/cm.

A 1.07-fold molar amount of $Sr(OH)_2.8H_2O$ was added to the hydrous titanium oxide, and the mixture was placed in a stainless steel (SUS) reaction vessel followed by purging with nitrogen gas. Further, distilled water was added so as to obtain 0.3 mol/L in terms of $SrTiO_3$.

The temperature of the slurry was raised to 87° C. at 70° C./h in a nitrogen atmosphere, and after reaching 87° C., the reaction was carried out for 4 h. After the reaction, the mixture was cooled to room temperature, the supernatant was removed, and washing was repeated with pure water.

Further, under a nitrogen atmosphere, the above slurry was put into an aqueous solution in which 1% by mass of sodium stearate was dissolved with respect to the solid content of the slurry, and an aqueous solution of zinc sulfate was added dropwise under stirring to precipitate zinc stearate on the surface of the perovskite type crystals.

The slurry was repeatedly washed with pure water, filtered through a Nutsche filter, and the resulting cake was dried to obtain strontium titanate fine particle surface-treated with zinc stearate. Fine particle A3 (strontium titanate fine particle) having a number average particle diameter of primary particles of 230 nm were obtained. Table 8 shows the physical properties of the fine particle A3.

Production Example of Fine Particle A4

A hydrous titanium oxide slurry obtained by hydrolyzing an aqueous solution of titanyl sulfate was washed with an aqueous alkaline solution. Next, hydrochloric acid was added to the slurry of hydrous titanium oxide to adjust the pH to 2.0 to obtain a titania sol-dispersed solution. NaOH was added to the titania sol-dispersed solution, the pH of the dispersion was adjusted to 5.5, and washing was repeated until the electric conductivity of the supernatant became 100 μS/cm.

A 1.07-fold molar amount of $Sr(OH)_2.8H_2O$ was added to the hydrous titanium oxide, and the mixture was placed in a stainless steel (SUS) reaction vessel followed by purging with nitrogen gas. Further, distilled water was added so as to obtain 0.3 mol/L in terms of $SrTiO_3$.

The temperature of the slurry was raised to 87° C. at 70° C./h in a nitrogen atmosphere, and after reaching 87° C., the reaction was performed for 4.5 h. After the reaction, the mixture was cooled to room temperature, the supernatant was removed, and washing was repeated with pure water.

The slurry including the precipitate was adjusted to 40° C., hydrochloric acid was added to adjust the pH to 2.5, 2.5% by mass, with respect to the solid content, of n-octyltriethoxysilane was added, and stirring and holding were continued for 10 h. The pH was adjusted to 6.5 by adding a 5 mol/L sodium hydroxide solution, and after stirring for 1 h, filtration and washing were performed, and the obtained cake was dried in the atmosphere at 120° C. for 8 h to obtain fine particle A4 (strontium titanate fine particle). Table 8 shows the physical properties of the fine particle A4.

Production Example of Fine Particle A5

Oxygen and argon gas were supplied at 50 $Nm^3/h$ and 2 $Nm^3/h$, respectively, to a combustor to form a field for ignition of aluminum powder. Next, aluminum powder (average particle diameter: about 45 μm, supply amount: 20 kg/h) was supplied from an aluminum powder supply device together with nitrogen gas (supply amount: 3.5 Nm % h) through the combustor to the reactor. The aluminum powder was oxidized in the reactor to obtain alumina particles. The alumina particles obtained after passing through the reactor were classified to remove fine and coarse powders and obtain fine particle A5 (alumina fine particle). Table 8 shows the physical properties of the fine particle A5.

Production Example of Fine Particle A6

Oxygen and argon gas were supplied at 50 $Nm^3/h$ and 2 $Nm^3/h$, respectively, to a combustor to form a field for ignition of aluminum powder. Next, aluminum powder (average particle diameter: about 45 μm, supply amount: 20 kg/h) was supplied from an aluminum powder supply device together with nitrogen gas (supply amount: 3.5 $Nm^3/h$) through the combustor to the reactor. The aluminum powder was oxidized in the reactor to obtain alumina particles.

The obtained alumina particles were dispersed in ethanol, and 3.0 parts of isobutyltrimethoxysilane as a surface treatment agent was added dropwise, mixed and reacted with respect to 100 parts of the alumina particles under stirring. After drying, heat treatment was conducted at 170° C. for 3 h, followed by repeated pulverization with a jet mill until alumina aggregates disappeared. Then, the alumina particles were classified to remove fine and coarse powders and obtain fine particle A6 (alumina fine particle). Table 8 shows the physical properties of the fine particle A6.

TABLE 8

| Fine particle A No. | Material | Volume resistivity R1 (Ω · cm) | Number average particle diameter L1 of primary particle (nm) |
|---|---|---|---|
| A1 | Titanium oxide | $8.5 \times 10^7$ | 20 |
| A2 | Strontium titanate | $3.4 \times 10^8$ | 30 |
| A3 | Strontium titanate | $5.5 \times 10^9$ | 230 |
| A4 | Strontium titanate | $1.2 \times 10^8$ | 260 |
| A5 | Alumina | $2.9 \times 10^9$ | 45 |
| A6 | Alumina | $1.2 \times 10^{10}$ | 45 |

Production Example of Fine Particle B1

A total of 100 parts of fumed silica (BET: 200 $m^2/g$) obtained by the dry method was used as a raw material and surface-treated with 15 parts of hexamethyldisilazane. Then, after surface treatment with 13 parts of dimethyl silicone oil having a viscosity of 100 mm/s at 25° C., pulverization and sieving were performed to obtain fine particle B1 (silica fine particle). Table 9 shows the physical properties of the fine particle B1.

Production Example of Fine Particle B2

First Step

A reaction vessel equipped with a thermometer and a stirrer was charged with 360.0 parts of water, and 15.0 parts of hydrochloric acid having a concentration of 5.0% by mass was added to prepare a uniform solution. A total of 133.0 parts of tetraethoxysilane was added to this while stirring at a temperature of 25° C., followed by stirring for 5 h, and then filtering to obtain a transparent reaction liquid including a silanol compound or a partial condensate thereof.

Second Step

A reaction vessel equipped with a thermometer, a stirrer, and a dropping device was charged with 540.0 parts of water, and 17.0 parts of ammonia water having a concentration of 10.0% by mass was added to obtain a uniform solution. While stirring the solution at a temperature of 35° C., 100 parts of the reaction solution obtained in the first step was added dropwise over 1.5 h, and stirring was performed for 8 h to obtain a suspension. The obtained suspension was centrifuged to precipitate fine particle, and the fine particle were taken out and dried in a dryer at a temperature of 200° C. for 24 h to obtain fine particle B2. Table 9 shows the physical properties of the fine particle B2.

Production Example of Fine Particle B3

A total of 100 parts of fumed silica (BET: 75 $m^2/g$) obtained by the dry method was used as a raw material and surface-treated with 15 parts of hexamethyldisilazane. Then, after surface-treating with 8 parts of dimethyl silicone oil having a viscosity at 25° C. of 100 $mm^2s$, a sieve classification treatment was performed without pulverization to obtain fine particle B3 (silica fine particle). Table 9 shows the physical properties of the fine particle B3.

Production Example of Fine Particle B4

First Step

A reaction vessel equipped with a thermometer and a stirrer was charged with 360.0 parts of water, and 15.0 parts of hydrochloric acid having a concentration of 5.0% by mass was added to prepare a uniform solution. A total of 133.0 parts of tetraethoxysilane was added to this while stirring at a temperature of 25° C., followed by stirring for 5 h, and then filtering to obtain a transparent reaction liquid including a silanol compound or a partial condensate thereof.

Second Step

A reaction vessel equipped with a thermometer, a stirrer, and a dropping device was charged with 540.0 parts of water, and 17.0 parts of ammonia water having a concentration of 10.0% by mass was added to obtain a uniform solution. While stirring the solution at a temperature of 35° C., 100 parts of the reaction solution obtained in the first step was added dropwise over 0.5 h, and stirring was performed for 5 h to obtain a suspension. The obtained suspension was centrifuged to precipitate fine particle, and the fine particle were taken out and dried in a dryer at a temperature of 200° C. for 24 h to obtain fine particle B4. Table 9 shows the physical properties of the fine particle B4.

TABLE 9

| Fine particle B No. | Material | Volume resistivity R2 (Ω · cm) | Number average particle diameter L2 of primary particle (nm) |
|---|---|---|---|
| B1 | Fumed silica | $6.9 \times 10^{14}$ | 25 |
| B2 | Sol-gel silica | $7.9 \times 10^{11}$ | 270 |
| B3 | Fumed silica | $6.9 \times 10^{14}$ | 310 |
| B4 | Sol-gel silica | $5.2 \times 10^{10}$ | 160 |

Production Example of Toner 1

Toner particles 1, fine particle A1 and fine particle B1 were mixed using an FM mixer (FM10C type, manufactured by Nippon Coke & Engineering Co., Ltd.).

With the water temperature in the jacket of the FM mixer stable at 25° C.±1° C., 0.7 parts of fine particle A1 and 1.0 parts of fine particle B1 were added to 100 parts of toner particles 1.

Mixing was started at a peripheral speed of the rotating blade of 28 m/sec and was performed for 4 min while controlling the water temperature and flow rate in the jacket so that the temperature inside the tank was stable at 25° C.±1° C., and then sieving was performed with a mesh with an opening of 75 μm to obtain a toner 1. Table 10 shows the production conditions of the toner 1.

Production Examples of Toners 2 to 9

Toners 2 to 9 were produced in the same manner as the toner 1, except that the type and the number of loaded parts of the fine particle A and the type and the number of loaded parts of the fine particle B were changed as shown in Table 10. Table 10 shows the production conditions of the toners 2 to 9.

TABLE 10

| | Fine particle A | | Fine particle B | | |
|---|---|---|---|---|---|
| Toner No. | Type | Number of added parts | Type | Number of added parts | R2/R1 |
| 1 | A1 | 0.7 | B1 | 1.0 | $8.1 \times 10^8$ |
| 2 | A2 | 0.7 | B1 | 1.0 | $2.0 \times 10^6$ |
| 3 | A3 | 0.7 | B1 | 1,0 | $1.3 \times 10^5$ |
| 4 | A4 | 0.7 | B1 | 1.0 | $5.8 \times 10^6$ |
| 5 | A2 | 0.7 | B2 | 1.0 | $2.3 \times 10^3$ |
| 6 | A2 | 0.7 | B3 | 1.0 | $2.0 \times 10^6$ |
| 7 | A5 | 0.7 | B1 | 1.0 | $2.4 \times 10^5$ |
| 8 | A6 | 0.7 | B1 | 1.0 | $5.8 \times 10^4$ |
| 9 | A2 | 0.7 | B4 | 1.0 | $1.5 \times 10^2$ |

Method for Measuring Volume Resistivity R1 of Fine Particle A and Volume Resistivity R2 of Fine Particle B The volume resistivity of the fine particle A and the fine particle B was calculated from the current value measured using an electrometer (manufactured by Keithley, 6430 type sub-femtoampere remote source meter).

A sample holder (SH2-Z type manufactured by Toyo Technica Co., Ltd.) of an upper-lower electrode sandwiching system was filled with 1.0 g of the fine particle, and the fine particle were compressed by applying a torque of 2.0 N·m.

The upper and lower electrodes having a diameter of 25 mm and 2.5 mm, respectively, were used. A voltage of 10.0 V was applied to the fine particle through the sample holder, the resistance value was calculated from the current value at the time of saturation when the charging current was not included, and the volume resistivity was calculated by the following formula.

The method of isolating the fine particle from the toner involved dispersing the toner in a solvent such as chloroform, then isolating the fine particle by the difference in specific gravity by centrifugation etc., and using the fine particle obtained herein to perform elemental analysis of the silica particles alone (ESCA measurement), thereby confirming the identification and uniqueness of the composition of the fine particle.

Where the fine particle can be obtained independently, the fine particle may be measured independently.

$$\text{Volume resistivity } (\Omega\cdot\text{cm}) = \text{resistance value } (\Omega) \times \text{electrode area } (\text{cm}^2)/\text{sample thickness (cm)}$$

Method for Measuring Number Average Particle Diameter L1 of Primary Particle of Fine Particle A The number average particle diameter L1 of the primary particle of the fine particle A was measured using a scanning electron microscope "S-4800" (trade name; manufactured by Hitachi, Ltd.).

By observing the toner, the major axis of primary particles of 100 fine particles was randomly measured in a field of view magnified up to 50,000 times to obtain the number average particle diameter. The observation magnification was adjusted, as appropriate, depending on the size of the fine particle.

Where the fine particle A can be obtained independently, the fine particle A may be measured independently.

Further, when fine particle other than the fine particle A were included in the toner observation, the EDS analysis was performed on each fine particle to identify the fine particle analyzed.

Method for Measuring Number Average Particle Diameter L2 of Primary Particle of Fine Particle B The number average particle diameter of the primary particles of the fine particle B was measured using the scanning electron microscope "S-4800" (trade name; manufactured by Hitachi. Ltd.).

By observing the toner, the major axis of primary particles of 100 fine particle B was randomly measured in a field of view magnified up to 50,000 times to obtain the number average particle diameter. The observation magnification was adjusted, as appropriate, depending on the size of the fine particle B.

Where the fine particle B can be obtained independently, the fine particle B may be measured independently.

Further, when fine particle other than the fine particle B were included in the toner observation, the fine particle B were identified by performing the EDS analysis on each fine particle and comparing the ratio of the elemental content of Si and O (atomic %)(Si/O ratio) with a standard. HDK V15 (Asahi Kasei Corporation) was used as a standard of silica fine particle.

Example 1

The conductive member 1 and the toner 1 were used and evaluated as follows. The evaluation results are shown in Table 11.

An electrophotographic laser printer (trade name: LBP9950Ci, manufactured by Canon Inc.) was prepared as an electrophotographic device. Next, the conductive member 1, the electrophotographic apparatus, and the process cartridge were allowed to stand in an environment of 23° C. and 50% RH for 48 h for the purpose of adjusting to the measurement environment.

The following modifications were made for evaluation in a high-speed process.

The modifications involved setting the rotation speed of the developing roller to a two-fold peripheral speed of the drum and changing the process speed to 330 mm/sec by changing the gear of the evaluation machine body and software.

After removing the toner contained in the toner cartridge of the LBP9950Ci and cleaning the inside with an air blower, 180 g of the toner 1 to be evaluated was loaded therein.

Furthermore, the conductive member 1 was set as the charging roller of the process cartridge and incorporated into the laser printer, and a pre-exposure device in the laser printer was removed.

Due to the above modifications, the toner, the fine particle A and the fine particle B slip by the cleaning blade, which results in a stricter mode for evaluating the contamination level of the conductive member, roughness level, and fogging level.

Next, in the aforementioned environment as it is, 20.000 images having a print percentage of 4.0% were printed out in lateral direction of A4 paper in the central portion with a margin of 50 mm on each of the left and right sides, and the evaluation was performed for the initial image and after outputting 20,000 prints. Table 11 shows the physical properties of the toner and the evaluation results of the actual machine.

Evaluation of Charging Ability

The process cartridge was modified and a surface potential probe (main unit: Model 347, manufactured by Trek, Inc., probe: Model 3800S-2) was installed so that the drum surface potential after the charging process could be measured.

A voltage of −1000 V was applied to the conductive member 1 by an external power source (Trek 615 manufactured by Trek Japan Co., Ltd.) under the same environment of 23° C. and 50% RH as described above, a solid white image and a solid black image were outputted, and the surface potential of the photosensitive drum during the output was measured.

Then, the difference in the surface potential of the photosensitive drum after the charging process when a solid black image was outputted and when a solid white image was outputted was calculated as the charging ability of the conductive member 1. The evaluation results are shown in Table 11 as "Black-and-white potential difference".

A: The black-and-white potential difference is less than 10 V.

B: The black-and-white potential difference is at least 10 V and less than 30 V.

C: The black-and-white potential difference is at least 30 V and less than 50 V.

D: The black-and-white potential difference is at least 50 V.

Roughness Evaluation

Under the same environment of 23° C. and 50% RH as described above, halftone images were printed at the time of checking and the roughness was evaluated. Using a digital microscope VHX-500 (lens: wide-range zoom lens VH-Z100, manufactured by Keyence Corporation), the area of 1000 dots was measured for the check image.

The number average (S) of dot areas and the standard deviation (a) of dot areas were calculated, and a dot reproducibility index was calculated by the following formula.

Then, the roughness of the halftone image was evaluated by the dot reproducibility index (I).

The smaller the dot reproducibility index (I), the better the dot reproducibility.

$$\text{Dot reproducibility index } (I) = \sigma / S \times 100$$

A: I is less than 2.0.

B: I is at least 2.0 and less than 4.0.

C: I is at least 4.0 and less than 6.0.

D: I is at least 6.0 and less than 8.0.

E: I is at least 8.0.

Evaluation of Fogging on Non-Image Portion

First, the initial image was evaluated under the same environment of 23° C. and 50% RH as described above.

In addition, up to 20,000 sheets were printed out under the same environment and after 20,000 prints were outputted, the humidity was adjusted to 15° C., 10% RH (LL), and 30° C., 80% RH (HH) for 24 h.

Under each environment, five white background images were outputted, and the fogging rate was measured for each image to obtain the maximum value, which was taken as the fogging rate after durability. The fogging rate was measured as follows.

Using a digital white photometer (TC-6D type, manufactured by Tokyo Denshoku Co., Ltd., using a green filter) for the evaluation image and the white paper before passing, a reflectance (%) was measured at S points per sheet, and the average reflectance (%) was calculated for each sheet. The difference between the average reflectance (%) of the white paper and the average reflectance (%) of the evaluation image was defined as the fogging rate (%). The evaluation results are shown in Table 11.

Bond paper (basis weight 75 g/m$^2$) was used as the evaluation paper.

A: The fogging rate is less than 0.5%.

B: The fogging rate is at least 0.5% and less than 1.0%.

C: The fogging rate is at least 1.0% and less than 1.5%.

D: The fogging rate is at least 1.5%.

Examples 2 to 11 and Comparative Examples 1 to 5

The evaluation was performed in the same manner as in Example 1 except that the toner and the conductive member were changed as shown in Table 11. The evaluation results are shown in Table 11.

TABLE 11

| | Toner No. | Conductive member No. | L2 < Lws | R1/Rd | Charging ability Initial | Charging ability After durability | Roughness Initial | Roughness After durability | Fogging Initial | Fogging LL After durability | Fogging HH After durability |
|---|---|---|---|---|---|---|---|---|---|---|---|
| Example 1 | 1 | 1 | Yes | $5.1 \times 10^6$ | A(1 V) | A(3 V) | A(0.3) | A(0.5) | A(0.2%) | A(0.3%) | A(0.3%) |
| Example 2 | 2 | 2 | Yes | $1.3 \times 10^7$ | B(10 V) | B(15 V) | A(1.0) | B(2.2) | A(0.2%) | A(0.3%) | A(0.3%) |
| Example 3 | 2 | 3 | Yes | $5.5 \times 10^6$ | B(15 V) | C(33 V) | B(2.3) | B(3.0) | A(0.3%) | A(0.4%) | A(0.4%) |
| Example 4 | 2 | 4 | Yes | $1.1 \times 10^2$ | B(16 V) | C(35 V) | C(4.3) | C(5.2) | A(0.4%) | B(0.6%) | B(0.7%) |
| Example 5 | 2 | 5 | Yes | $1.3 \times 10^7$ | A(2 V) | C(37 V) | A(1.5) | C(4.3) | A(0.4%) | B(0.6%) | B(0.6%) |
| Example 6 | 3 | 2 | Yes | $2.1 \times 10^8$ | B(10 V) | C(31 V) | B(2.2) | B(2.8) | A(0.4%) | B(0.8%) | A(0.4%) |
| Example 7 | 4 | 2 | Yes | $4.7 \times 10^6$ | B(10 V) | B(28 V) | B(2.4) | B(3.1) | A(0.4%) | C(1.3%) | A(0.4%) |
| Example 8 | 5 | 3 | Yes | $5.5 \times 10^6$ | B(15 V) | C(41 V) | B(3.0) | C(4.7) | B(0.6%) | B(0.6%) | C(1.2%) |
| Example 9 | 5 | 2 | No | $1.3 \times 10^7$ | B(10 V) | B(29 V) | A(1.9) | B(3.5) | B(0.7%) | B(0.9%) | C(1.3%) |
| Example 10 | 6 | 2 | No | $1.3 \times 10^7$ | B(10 V) | C(32 V) | A(1.9) | B(3.6) | B(0.7%) | C(1.3%) | C(1.4%) |
| Example 11 | 7 | 2 | Yes | $1.1 \times 10^8$ | B(10 V) | C(43 V) | A(1.7) | B(3.5) | A(0.4%) | C(1.3%) | A(0.4%) |
| Comparative Example 1 | 2 | 6 | — | — | D(90 V) | D(95 V) | C(5.9) | E(8.8) | B(0.8%) | D(1.5%) | D(1.6%) |
| Comparative Example 2 | 2 | 7 | Yes | $6.5 \times 10^6$ | D(62 V) | D(70 V) | C(5.2) | D(6.7) | A(0.4%) | B(0.7%) | B(0.9%) |
| Comparative Example 3 | 2 | 8 | Yes | $1.1 \times 10^5$ | D(77 V) | D(87 V) | C(5.6) | E(8.2) | A(0.4%) | B(0.8%) | B(0.9%) |
| Comparative Example 4 | 8 | 2 | Yes | $4.7 \times 10^8$ | B(10 V) | D(83 V) | A(1.7) | B(3.7) | A(0.4%) | D(1.8%) | A(0.4%) |
| Comparative Example 5 | 9 | 2 | Yes | $1.3 \times 10^7$ | B(10 V) | C(45 V) | A(1.8) | D(6.5) | A(0.4%) | B(0.7%) | D(1.9%) |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-191587, filed Oct. 18, 2019 which is hereby incorporated by reference herein in its entirety.

What is claimed is:

1. An electrophotographic apparatus comprising:

an electrophotographic photosensitive member;

a charging device for charging a surface of the electrophotographic photosensitive member; and a developing device for developing an electrostatic latent image formed on the surface of the electrophotographic photosensitive member with a toner to form a toner image on the surface of the elecetrophotographic photosensitive member, wherein the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix, the matrix contains a first rubber, each of the domains contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^5$ times or more a volume resistivity Rd of the domains, the developing device comprises the toner, the toner comprises a toner particle containing a binder resin, and fine particle A and fine particle B both on a surface of the toner particle, the fine particle A has a volume resistivity R1 of $1.0\times10^3$ to $1.0\times10^{10}$ Ω·cm, the fine particle B is silica fine particle, and the fine particle B has a volume resistivity R2 of $1.0\times10^{11}$ to $1.0\times10^{17}$ Ω·cm.

2. The electrophotographic apparatus according to claim 1, wherein the volume resistivity R2 of the fine particle B is $1.0\times10^5$ times or more the volume resistivity R1 of the fine particle A.

3. The electrophotographic apparatus according to claim 1, wherein the fine particle A has a primary particle having a number average particle diameter L1 of 10 to 300 nm.

4. The electrophotographic apparatus according to claim 1, wherein the fine particle A comprises at least one kind fine particle selected from the group consisting of a titanium oxide fine particle and a strontium titanate fine particle.

5. The electrophotographic apparatus according to claim 1, wherein the fine particle B has a primary particle having a number average particle diameter L2 of 5 to 200 nm.

6. The electrophotographic apparatus according to claim 1, wherein an arithmetic mean value Lw of distances between adjacent wall surfaces of the domains in the conductive layer in cross-sectional observation of the conductive member is from 0.20 to 6.00 μm.

7. The elecetrophotographic apparatus according to claim 1, wherein the number average particle diameter L2 (nm) of the primary particle of the fine particle B, and an arithmetic mean value Lws (nm) of distances between adjacent wall surfaces of the domains in the conductive layer when observing the outer surface of the conductive member satisfy a relationship of L2<Lws.

8. The electrophotographic apparatus according to claim 1, wherein the volume resistivity Rd (Ω·cm) of the domains, and the volume resistivity R1 (Ω·cm) of the fine particles A satisfy a relationship of a following formula (1):

$$1.0\times10^{-1}\leq R1/Rd\leq1.0\times10^{7} \quad (1).$$

9. A process cartridge detachably attachable to a main body of an electrophotographic apparatus, the process cartridge comprising:

a charging device for charging a surface of an electrophotographic photosensitive member; and a developing device for developing an electrostatic latent image formed on the surface of the electrophotographic photosensitive member with a toner to form a toner image on the surface of the electrophotographic photosensitive member, wherein the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix, the matrix contains a first rubber;

each of the domains contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^{5}$ times or more a volume resistivity Rd of the domains, the developing device comprises the toner, the toner comprises a toner particle containing a binder resin, and fine particle A and fine particle B both on a surface of the toner particle, the fine particle A has a volume resistivity R1 of $1.0\times10^{3}$ to $1.0\times10^{10}$ Ω·cm, the fine particle B is silica fine particle, and the fine particle B has a volume resistivity R2 of $1.0\times10^{11}$ to $1.0\times10^{17}$ Ω·cm.

10. A cartridge set that is detachably attachable to a main body of an electrophotographic apparatus and comprises a first cartridge and a second cartridge, wherein the first cartridge comprises a charging device for charging a surface of an electrophotographic photosensitive member; and a first frame for supporting the charging device, and the second cartridge comprises a toner container that accommodates a toner for developing an electrostatic latent image formed on the surface of the electrophotographic photosensitive member to form a toner image on the surface of the electrophotographic photosensitive member, the charging device comprises a conductive member arranged to be capable of contacting the electrophotographic photosensitive member, the conductive member comprises a support having a conductive outer surface, and a conductive layer provided on the outer surface of the support, the conductive layer comprises a matrix and a plurality of domains dispersed in the matrix, the matrix contains a first rubber, each of the domain contains a second rubber and an electronic conductive agent, at least some of the domains are exposed at the outer surface of the conductive member, the outer surface of the conductive member is composed of at least the matrix and the domains exposed at the outer surface of the conductive member, the matrix has a volume resistivity Rm of larger than $1.00\times10^{12}$ Ω·cm, the volume resistivity Rm of the matrix is $1.0\times10^{5}$ times or more a volume resistivity Rd of the domains, the toner comprises a toner particle containing a binder resin, and fine particle A and fine particle B both on a surface of the toner particle, the fine particle A has a volume resistivity R1 of $1.0\times10^{3}$ to $1.0\times10^{10}$ Ω·cm, the fine particle B is silica fine particle, and the fine particles B has a volume resistivity R2 of $1.0\times10^{11}$ to $1.0\times10^{17}$ Ω·cm.

* * * * *